US005501930A

United States Patent [19]

Kondo et al.

[11] Patent Number: 5,501,930

[45] Date of Patent: Mar. 26, 1996

[54] ELECTROPHOTOGRAPHIC PHOTORECEPTOR CONTAINING ENAMINE DERIVATIVE

[75] Inventors: Akihiro Kondo, Nara; Kiyofumi Morimoto, Tenri; Kazuhiro Emoto, Nagaokakyo, all of Japan

[73] Assignee: Sharp Kabushiki Kaisha, Osaka, Japan

[21] Appl. No.: 288,549

[22] Filed: Aug. 10, 1994

[30] Foreign Application Priority Data

| | | | |
|---|---|---|---|
| Aug. 26, 1993 | [JP] | Japan | 5-211497 |
| Mar. 23, 1994 | [JP] | Japan | 6-052184 |
| May 20, 1994 | [JP] | Japan | 6-106632 |

[51] Int. Cl.[6] ..... G03G 5/06

[52] U.S. Cl. ..... 430/59; 430/73; 430/78; 430/77

[58] Field of Search ..... 430/59, 71, 72, 430/73, 78, 79, 77

[56] References Cited

U.S. PATENT DOCUMENTS

| | | | |
|---|---|---|---|
| 4,606,988 | 8/1986 | Sasaki | 430/73 |
| 5,013,623 | 5/1991 | Itoh et al. | 430/73 |
| 5,089,366 | 2/1992 | Haino et al. | 430/59 |
| 5,389,479 | 2/1995 | Morimoto et al. | 430/59 |

FOREIGN PATENT DOCUMENTS

| | | | |
|---|---|---|---|
| 4232242 | 4/1993 | Germany | 430/59 |
| 58-46018 | 1/1979 | Japan . | |
| 54-59143 | 5/1979 | Japan . | |
| 57-19780 | 4/1982 | Japan . | |
| 58-32372 | 7/1983 | Japan . | |
| 58-198043 | 11/1983 | Japan . | |
| 62-237458 | 10/1987 | Japan . | |
| 6-43675 | 2/1994 | Japan . | |
| 6-83082 | 3/1994 | Japan . | |

OTHER PUBLICATIONS

*Grant & Hackh's Chemical Dictionary,* fifth edition, Grant et al. editors, McGraw–Hill, p. 24, "alkyl" (1987).

*Primary Examiner*—Christopher D. Rodee
*Attorney, Agent, or Firm*—Nixon & Vanderhye

[57] ABSTRACT

An electrophotographic photoreceptor is herein disclosed which comprises a conductive support and a photosensitive layer formed on the conductive support, and the photosensitive layer contains an enamine derivative as a carrier transport material represented by the formula wherein Ar is an aryl group which may have a substituent, a heterocyclic group which may have a substituent, an aralkyl group which may have a substituent, or a heterocyclic substituted alkyl group; and n is 2, 3 or 4.

The electrophotographic photoreceptor is excellent in sensitivity and durability.

6 Claims, 14 Drawing Sheets

13C-NMR-NORMAL

13C-NMR-NORMAL

13C-NMR-NORMAL

ELECTROPHOTOGRAPHIC PHOTORECEPTOR CONTAINING ENAMINE DERIVATIVE

BACKGROUND OF THE INVENTION (i) Field of the Invention

The present invention relates to an improved electrophotographic photoreceptor for use in various printing machines and copying machines.

(ii) Description of the Related Art

In general, there are various electrophotographic processes, and typical known examples thereof include a direct process and a latent image transfer process. In each electrophotographic process, an electrophotographic photoreceptor is used, and this electrophotographic photoreceptor contains a photoconductive layer which is made from a photoconductive material. Here, the photoconductive material should possess following fundamental characteristics:

(1) that a high charging potential is generated by corona discharge in the dark, (2) that the electric charges generated by the corona discharge scarcely attenuate in the dark, (3) that the electric charges are eliminated promptly by light irradiation, (4) that less electric charges remain after the light irradiation, (5) that a residual potential is scarcely increased and an initial potential is scarcely decreased, even when repeatedly used, and (6) that electrophotographic properties scarcely change by temperature and humidity.

As materials which can meet the above-mentioned requirements, there have been used inorganic photoconductive materials such as zinc oxide [Japanese Patent Publication No. (Sho) 57-19780], cadmium sulfide [Japanese Patent Publication No. (Sho) 58-46018] and amorphous selenium alloys, but in recent years, various problems are taken up. That is to say, when the zinc oxide material is used, the addition of a sensitizer is necessary to increase a sensitization effect, but owing to the presence of the sensitizer, the charging by the corona discharge declines and decoloration tend to occur by exposure. In consequence, a stable image cannot be kept up for a long period of time. With regard to the cadmium sulfide material, a stable sensitivity cannot be obtained under the conditions of a high humidity. The selenium material has some drawbacks such as the easy advancement of crystallization due to external factors such as temperature and humidity, the deterioration of charging properties, the occurrence of white dots on an image, the difficulty of manufacture and strong toxicity.

In view of future views, researches have been actively conducted on electrophotographic photoreceptors made of organic materials instead of inorganic materials which have problems such as exhaustion of resources, toxicity and environmental pollution. As a result, the electrophotographic photoreceptors using various kinds of organic compounds have been developed. Among others, according to the researches and developments in the last several years, there is the tendency that the conception of double-layered photoconductive structures is positively taken in consideration. Above all, a main conception which has now been investigated is that a carrier generation layer and a carrier transport layer in which positive holes are mobile are laminated in this order, and in general, the surface of the carrier transport layer is negatively charged with electricity.

As described above, the separation of the functions permits to independently develop materials having the functions of the generation of the carrier and materials having the function of the transport of the carrier, and as a result, many carrier generation materials and carrier transport materials having various molecular structures have been developed.

According to the classification of the carrier transport materials from structural characteristics, these typical examples already developed include hydrazone compounds [Japanese Patent Application Laid-open No. (Sho) 54-59143], stilbene-styryl compounds [Japanese Patent Application Laid-open No. (Sho) 58-198043], triarylamine compounds [Japanese Patent Publication No. (Sho) 58-32372], phenothiazine compounds, triazole compounds, quinoxaline compounds, oxadiazole compounds, oxazole compounds, pyrazoline compounds, triphenylmethane compounds, dihydronicotinamide compounds, indoline compounds and semicarbazone compounds.

As mentioned above, however, as the carrier transport materials, many organic compounds have been developed, but there has been no organic compound which can solve all of the problems of:

(1) compatibility to a binder being low, (2) crystals being easily deposited, (3) sensitivity change being liable to occur, when repeatedly used, (4) charging properties and repeating properties being poor, and (5) residual potential properties being poor.

In consequence, there has not been obtained any material which can meet the above-mentioned fundamental characteristics required as the photoreceptor, further mechanical strength, durability and the like.

SUMMARY OF THE INVENTION

Thus, an object of the present invention is to provide an electrophotographic photoreceptor having a high sensitivity and a high durability.

Another object of the present invention is to provide an electrophotographic photoreceptor which has an excellent stability to temperature and humidity and high charging properties and which can maintain a high sensitivity, even when repeatedly used.

According to the present invention, there is provided an electrophotographic photoreceptor, comprising:

a conductive support; and a photosensitive layer formed on the conductive support, the photosensitive layer containing an enamine derivative as a carrier transport material represented by the formula (I)

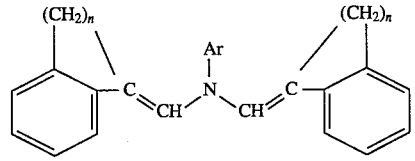

(I)

wherein Ar is an aryl group which may have a substituent, a heterocyclic group which may have a substituent, an aralkyl group which may have a substituent, or a heterocyclic substituted alkyl group; and n is 2, 3 or 4.

DESCRIPTION OF THE PREFERRED EMBODIMENTS

Figure 1:
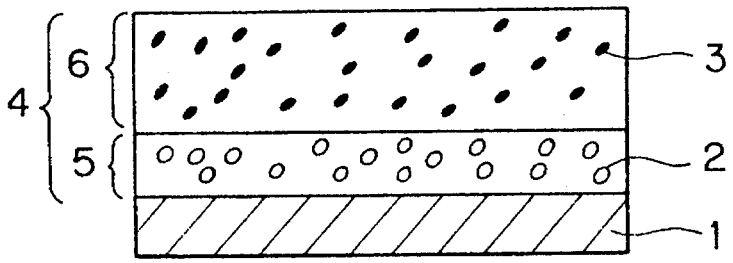
FIG. 1 is a sectional view schematically showing a laminated electrophotographic photoreceptor in which a photosensitive layer comprises a carrier generation layer and a carrier transport layer.

As described above, the first aspect of the present invention is directed to an electrophotographic photoreceptor which comprises a photosensitive layer containing an enamine derivative represented by the formula (I).

An example of the preferable enamine derivative represented by the formula (I) is a compound represented by the formula (II)

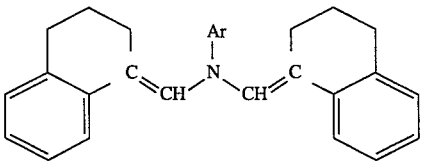

(II)

wherein Ar is an aryl group which may have a substituent, a heterocyclic group which may have a substituent, an aralkyl group which may have a substituent, or a heterocyclic substituted alkyl group; and n is 2, 3 or 4.

Furthermore, the second aspect of the present invention is directed to an electrophotographic photoreceptor in which a photosensitive layer contains a carrier transport material and a carrier generation material, and the charge carrier transport substance is an enamine derivative represented by the formula (I).

In addition, the third aspect of the present invention is directed to an electrophotographic photoreceptor in which a photosensitive layer comprises a carrier generation layer containing a carrier generation material and a carrier transport layer containing a carrier transport material, and the carrier transport material is an enamine derivative represented by the formula (I).

The substituent Ar of the enamine derivative represented by the formula (I) for use in an electrophotographic photoreceptor of the present invention is an aryl group which may have a substituent, a heterocyclic group which may have a substituent, an aralkyl group which may have a substituent, or a heterocyclic substituted alkyl group.

Typical examples of the substituent Ar include aryl groups such as phenyl, tolyl, methoxyphenyl, ethoxyphenyl, isopropylphenyl, fluorophenyl, trifluoromethylphenyl, dimethylaminophenyl, naphthyl, methylnaphthyl, biphenyl, methylbiphenyl, methoxybiphenyl, anthryl, tetralinyl and indanyl; heterocyclic groups such as pyridyl, pyrimidyl, benzothiofuranyl, fluorenonyl, acridinyl, 2,1,3-benzothiadiazolyl, 2-benzothiadiazolyl, 6-methoxy-2-benzothiadiazolyl, 2-benzoxazolyl, 2-methyl-5-benzoxazolyl, 4-phenyl-2-thiazolyl, 5-ethyl-2-1,3,4-thiadiazolyl and 5-methyl-3-isoxazolyl; aralkyl groups such as benzyl, methoxybenzyl and methylbenzyl; and heterocyclic substituted alkyl groups such as thienylmethyl. Above all, the aryl group not substituted or substituted by an electron donative group is effective.

Particularly preferable examples of the substituent Ar include aryl groups such as phenyl, p-methoxyphenyl, m-methoxyphenyl, p-ethoxyphenyl, m-ethoxyphenyl, p-tolyl, m-tolyl, m-ethylphenyl, m-isopropylphenyl, 3,5-xylyl, m-chlorophenyl, 1-naphthyl, m-dimethylaminophenyl; and heterocyclic groups such as 2-pyridyl, 6-methoxy-2-benzothiadiazolyl and 2-methyl-5-benzoxazolyl.

The enamine derivative represented by the formula (I) for use in the electrophotographic photoreceptor of the present invention can be synthesized by various methods, but in general, it can easily be synthesized in accordance with the following procedure. That is to say, a primary amine compound represented by the formula (VIII) and 2 equivalents of an aldehyde compound represented by the formula (IX) are heated in the presence of an acid catalyst in a solvent such as benzene to carry out dehydration-condensation, thereby obtaining the enamine derivative (I) of the present invention:

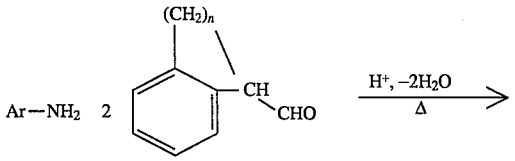

(VIII) (IX)

-continued

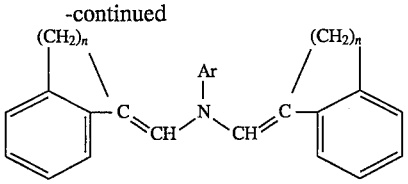

(I)

In the present invention, the above-mentioned enamine derivative is used as a carrier transport material.

Typical examples of the enamine derivative represented by the formula (I) for use in the electrophotographic photoreceptor of the present invention include exemplary compounds having substituents shown in Tables 1 to 5:

TABLE 1

| Exemplary Compound No. | Substituent on Formula (I) n | Ar |
|---|---|---|
| | (I) | |
| 1 | 3 | 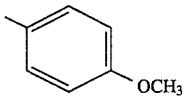 |
| 2 | 3 | 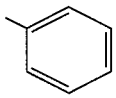 |
| 3 | 3 | 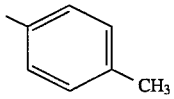 |
| 4 | 3 | 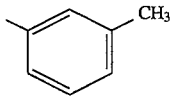 |
| 5 | 3 | 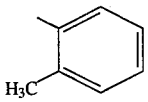 |
| 6 | 3 | 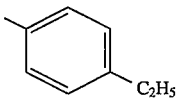 |
| 7 | 3 | 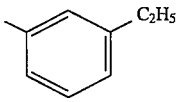 |
| 8 | 3 | 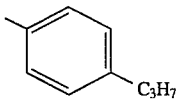 |
| | (II) | |
| 9 | 3 | 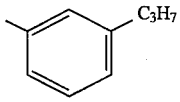 |

TABLE 1-continued

| Exemplary Compound No. | Substituent on Formula (I) n | Ar |
|---|---|---|
| 10 | 3 | 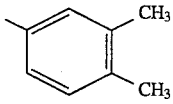 |
| 11 | 3 | 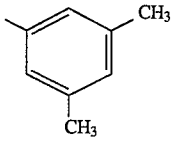 |
| 12 | 3 | 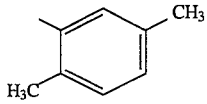 |
| 13 | 3 | 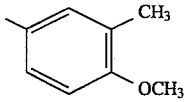 |
| 14 | 3 | 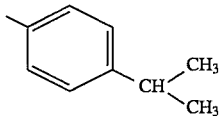 |
| 15 | 3 | 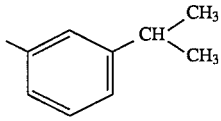 |
| | (III) | |
| 16 | 3 | 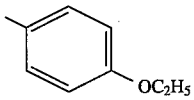 |
| 17 | 3 | 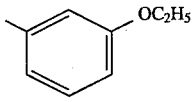 |
| 18 | 3 | 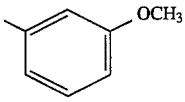 |
| 19 | 3 | 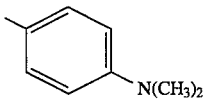 |
| 20 | 3 | 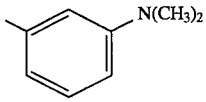 |
| 21 | 3 | 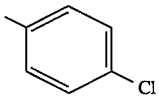 |

TABLE 1-continued
| Exemplary Compound No. | Substituent on Formula (I) n | Ar |
|---|---|---|
| 22 | 3 | 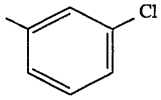 |
TABLE 2
| Exemplary Compound No. | Substituent on Formula (I) n | Ar |
|---|---|---|
| | | (I) |
| 23 | 3 | 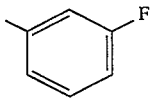 |
| 24 | 3 | 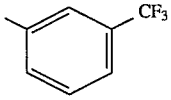 |
| 25 | 3 | 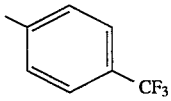 |
| 26 | 3 | 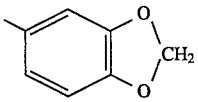 |
| 27 | 3 | 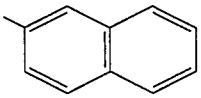 |
| 28 | 3 | 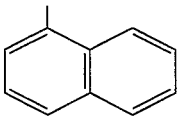 |
| 29 | 3 | 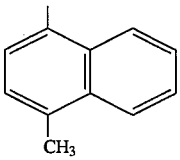 |
| | | (II) |
| 30 | 3 | 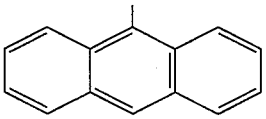 |
| 31 | 3 | 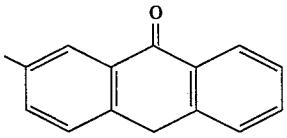 |
TABLE 2-continued
| Exemplary Compound No. | Substituent on Formula (I) n | Ar |
|---|---|---|
| 32 | 3 | 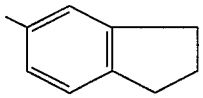 |
| 33 | 3 | 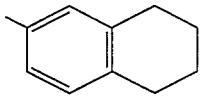 |
| 34 | 3 | 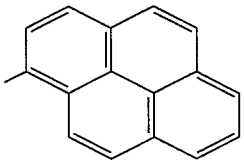 |
| 35 | 3 | 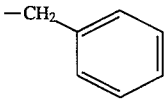 |
| 36 | 3 | 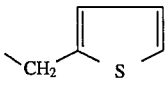 |
| | | (III) |
| 37 | 3 | 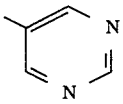 |
| 38 | 3 | 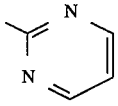 |
| 39 | 3 | 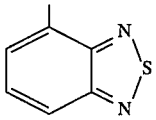 |
| 40 | 3 | 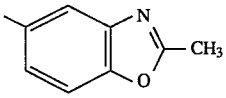 |
| 41 | 3 | 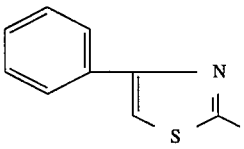 |
| 42 | 3 | 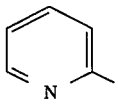 |
| 43 | 3 | 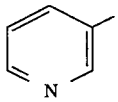 |

TABLE 2-continued
| Exemplary Compound No. | Substituent on Formula (I) n | Ar |
|---|---|---|
| 44 | 3 | 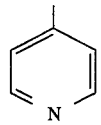 |
TABLE 3
| Exemplary Compound No. | Substituent on Formula (I) n | Ar |
|---|---|---|
| | | (I) |
| 45 | 3 | 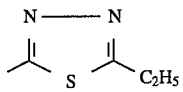 |
| 46 | 3 | 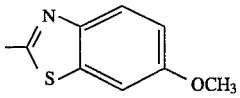 |
| 47 | 3 | 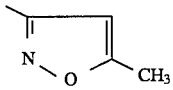 |
| 48 | 3 | 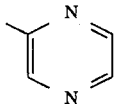 |
| 49 | 3 | 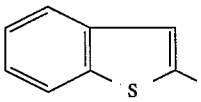 |
| 50 | 3 | 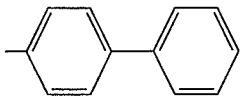 |
| 51 | 3 | 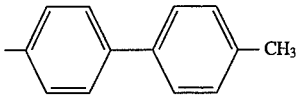 |
| | | (II) |
| 52 | 3 | 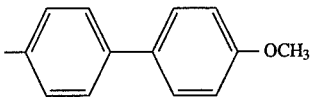 |
| 53 | 3 | 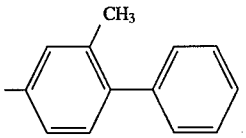 |
| 54 | 3 | 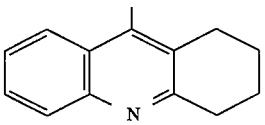 |
TABLE 3-continued
| Exemplary Compound No. | Substituent on Formula (I) n | Ar |
|---|---|---|
| 55 | 2 | 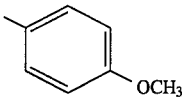 |
| 56 | 2 | 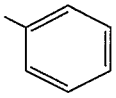 |
| 57 | 2 | 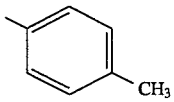 |
| 58 | 2 | 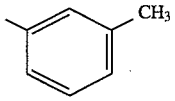 |
| 59 | 2 | 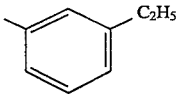 |
| | | (III) |
| 60 | 2 | 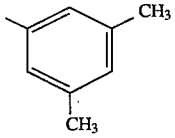 |
| 61 | 2 | 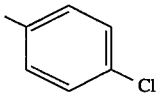 |
| 62 | 2 | 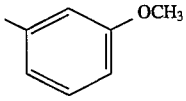 |
| 63 | 2 | 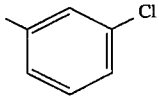 |
| 64 | 2 | 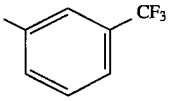 |
| 65 | 2 | 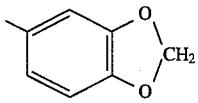 |
| 66 | 2 | 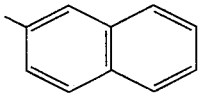 |

TABLE 4
| Exemplary Compound No. | Substituent on Formula (I) n | Ar |
|---|---|---|
| | | (I) |
| 67 | 2 | 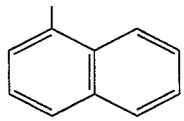 |
| 68 | 2 | 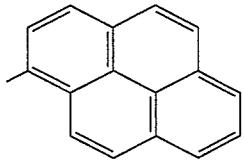 |
| 69 | 2 | 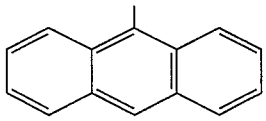 |
| 70 | 2 | 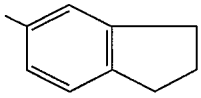 |
| 71 | 2 | 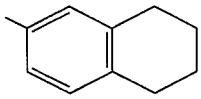 |
| 72 | 2 | 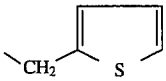 |
| 73 | 2 | 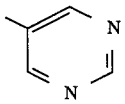 |
| | | (II) |
| 74 | 2 | 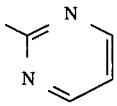 |
| 75 | 2 | 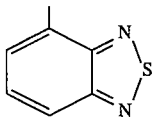 |
| 76 | 2 | 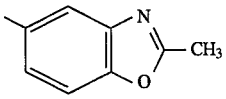 |
| 77 | 2 | 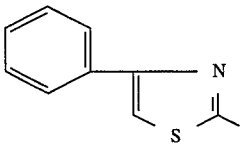 |
TABLE 4-continued
| Exemplary Compound No. | Substituent on Formula (I) n | Ar |
|---|---|---|
| 78 | 2 | 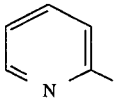 |
| 79 | 2 | 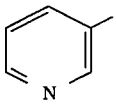 |
| 80 | 2 | 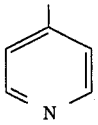 |
| | | (III) |
| 81 | 2 | 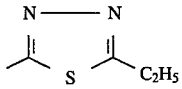 |
| 82 | 2 | 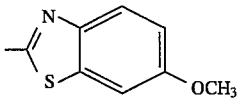 |
| 83 | 2 | 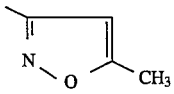 |
| 84 | 2 | 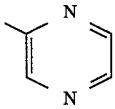 |
| 85 | 2 | 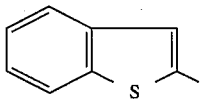 |
| 86 | 2 | 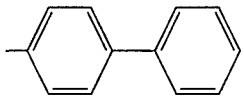 |
| 87 | 2 | 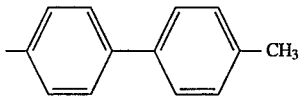 |
| 88 | 2 | 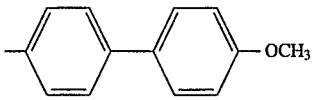 |

TABLE 5

| Exemplary Compound No. | Substituent on Formula (I) n | Ar |
|---|---|---|
| | | (I) |
| 89 | 2 | 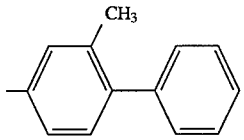 |
| 90 | 2 | 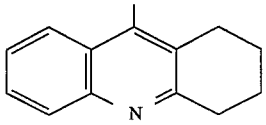 |
| 91 | 4 | 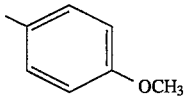 |
| 92 | 4 | 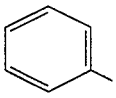 |
| 93 | 4 | 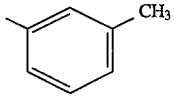 |
| 94 | 4 | 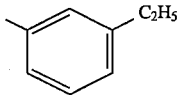 |
| 95 | 4 | 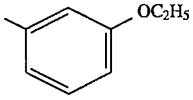 |
| 96 | 4 | 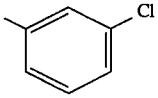 |
| | | (II) |
| 97 | 4 | 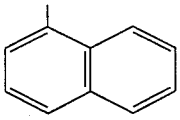 |
| 98 | 4 | 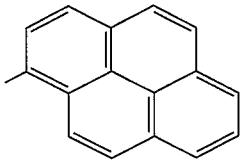 |
| 99 | 4 | 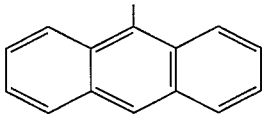 |

TABLE 5-continued

| Exemplary Compound No. | Substituent on Formula (I) n | Ar |
|---|---|---|
| 100 | 4 | 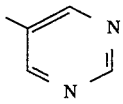 |
| 101 | 4 | 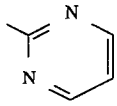 |
| 102 | 4 | 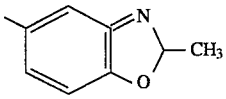 |
| 103 | 4 | 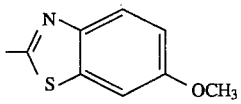 |
| | | (III) |
| 104 | 4 | 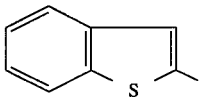 |
| 105 | 4 | 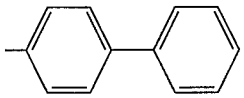 |
| 106 | 4 | 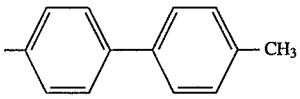 |
| 107 | 4 | 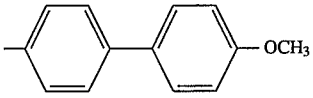 |
| 108 | 4 | 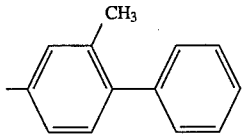 |

Among these exemplary compounds, what are excellent from the viewpoints of electrophotographic properties, cost and a synthetic procedure are compounds of Nos. 1, 2, 3, 4, 7, 11, 15, 16, 22, 26, 28, 42, 56, 57, 58, 59, 63, 67, 78, 82, 91, 92, 93, 94, 96 and 97.

Another preferable example of the enamine derivative represented by the formula (I) is an enamine derivative represented by the formula (III)

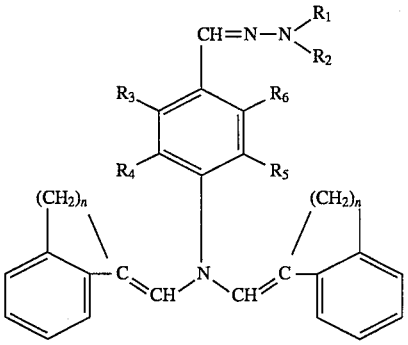

(III)

wherein $R_1$ and $R_2$ may be the same or different and they are each a lower alkyl group, an aryl group, an aralkyl group, a heterocyclic group or a heterocyclic alkyl group, or $R_1$ and $R_2$ may form a nitrogen-containing heterocyclic group together with a nitrogen atom bonded thereto; $R_3$, $R_4$, $R_5$ and $R_6$ may be the same or different and they are each a hydrogen atom, a halogen atom, a lower alkyl group, a lower alkoxy group or a lower dialkylamine group; and n is an integer of 2 to 4.

This enamine derivative is a compound mentioned at the end of literature.

Next, reference will be made to substituents of the enamine derivative represented by the formula (III).

Examples of the lower alkyl groups represented by $R_1$ and $R_2$ include methyl, ethyl, n-propyl, iso-propyl, n-butyl, sec-butyl and n-pentyl groups.

Examples of the aryl groups include phenyl, 1-naphthyl and 9-anthraceryl groups. At least one of hydrogen atoms of each aryl group may be substituted by methyl, methoxy or a halogen. Examples of the substituted aryl group include p-tolyl, 3,5-xylyl, p-methoxyphenyl, p-chlorophenyl and 2-methyl-1-naphthyl groups.

Examples of the aralkyl groups include a benzyl group and a phenylethyl group, and examples of these groups each having substituent include p-methoxybenzyl, p-methylbenzyl and p-chlorobenzyl.

Examples of the heterocyclic groups include 2-furyl, 3-furyl, 2-thienyl, 3-thienyl, 2-pyridyl, 2-benzothiazoyl and 2-benzooxazoyl groups, and these heterocyclic groups each having substituent can also be used.

Examples of the heterocyclic alkyl groups include 2-thienylmethyl, 2-furylmethyl, 3-furylmethyl, 3-thienylmethyl, 2-pyridylmethyl, 2-benzothiazoylmethyl and 2-benzoxazoylmethyl groups, and these heterocyclic groups each having substituent can also be used. Above all, 2-thienylmethyl and 3-thienylmethyl groups are preferable.

Examples of the nitrogen-containing heterocyclic groups formed together with the nitrogen atom bonded to $R_1$ and $R_2$ include:

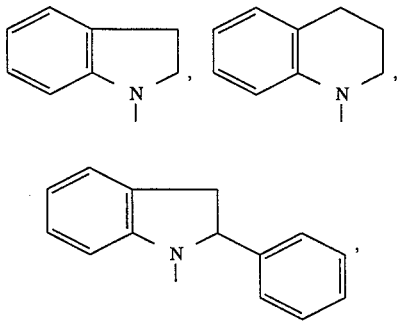

-continued

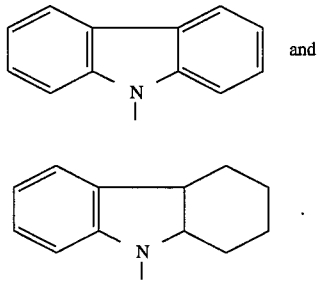

Among the above-mentioned substituents, preferable examples of $R_1$ and $R_2$ include the lower alkyl groups, the aryl groups and the nitrogen-containing heterocyclic groups formed together with the nitrogen atom bonded thereto. A particularly preferable example of the lower alkyl groups is the methyl group. A particularly preferable example of the aryl groups is the phenyl group, and a particularly preferable examples of the nitrogen-containing heterocyclic group are

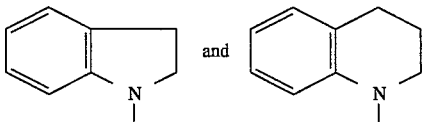

Furthermore, preferable examples of these nitrogen-containing heterocyclic groups having substituents are

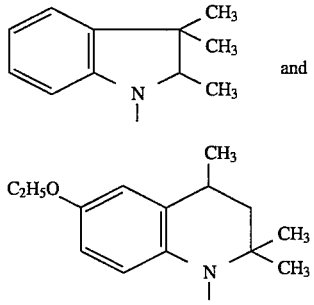

$R_3$, $R_4$, $R_5$ and $R_6$ may be the same or different and they are each a hydrogen atom, a halogen atom, a lower alkyl group, a lower alkoxy group or a lower dialkylamine group, and above all, the hydrogen atom or an electron donative group is preferable. Examples of the electron donative groups include a methyl group, an ethyl group, a propyl group, a methoxy group and a dimethylamino group.

In the present invention, preferable is the enamine derivative in which $R_3$, $R_4$, $R_5$ and $R_6$ are the hydrogen atoms or any one of them is the lower alkyl group.

In the present invention, the enamine derivative represented by the formula (III) can be synthesized by, for example, the following two methods.

According to the first method, a 4-nitrobenzaldehyde derivative (X) and a hydrazine derivative (XI) are first heated in the presence of a condensation catalyst in, for example, ethanol to synthesize 4-nitrobenzhydrazone derivative (XII), as shown by the formula (a):

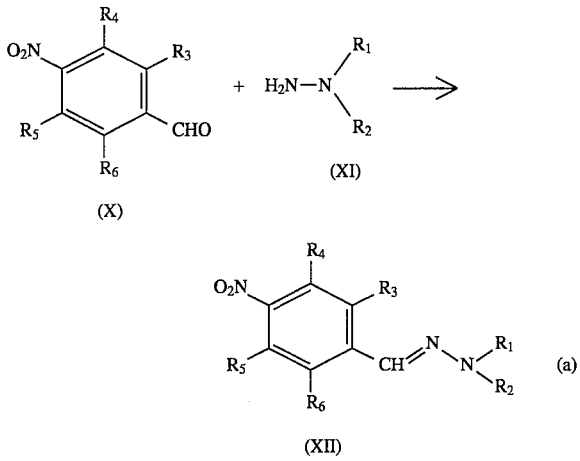

(a)

Examples of the above-mentioned catalyst include potassium acetate, sodium acetate and acetic acid.

Next, the 4-nitrobenzhydrazone derivative (XII) is reduced by the use of an iron powder and an acid, while heated in, for example, a mixed solvent of 1,4-dioxane and water, to synthesize 4-aminobenzhydrazone derivative (XIII), as shown in the following formula (b):

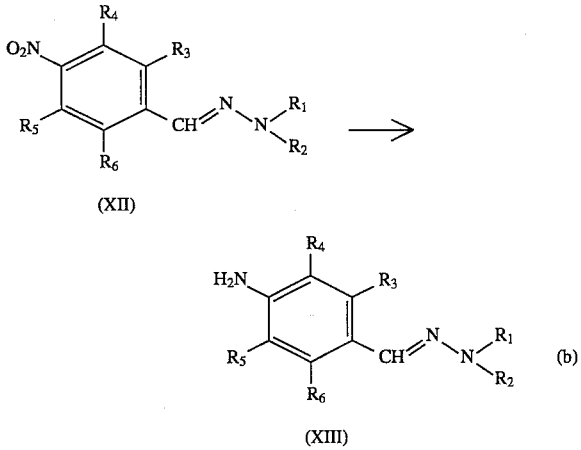

(b)

Examples of the above-mentioned acid for this reduction include an aqueous acetic acid solution and an aqueous hydrochloric acid solution.

Next, the 4-aminobenzhydrazone derivative (XIII) and an aldehyde substituted by a condensed polycyclic hydrocarbon (XIV) are condensed in the presence of an acid catalyst, while heated in, for example, toluene to synthesize the enamine derivative which is a desired compound (III), as shown in the following formula (c):

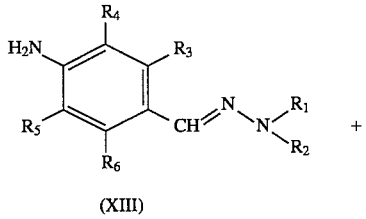

-continued

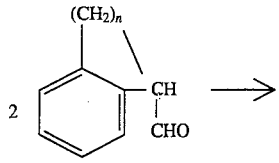

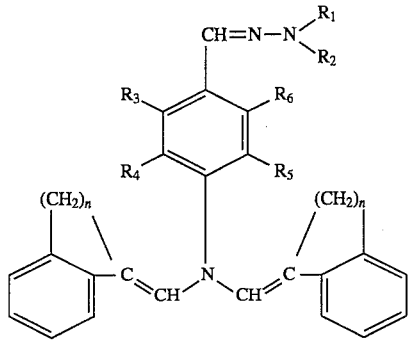

(c)

Examples of the above-mentioned acid catalyst for the condensation include p-toluenesulfonic acid and camphorsulfonic acid.

According to the second method, an aniline derivative (XV) and the aldehyde substituted by a condensed polycyclic hydrocarbon (XIV) are condensed in the presence of an acid catalyst, while heated in, for example, toluene to synthesize an aniline derivative substituted by a condensed polycyclic vinylidene (XVI), as shown in the following formula (d):

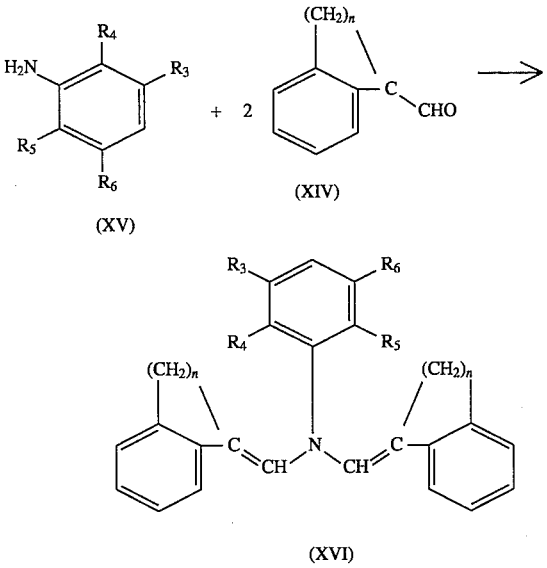

(d)

Examples of the above-mentioned acid catalyst for the condensation include p-toluenesulfonic acid and camphorsulfonic acid.

Next, the aniline derivative substituted by the condensed polycyclic vinylidene (XVI) is treated with, for example, N,N-dimethylformamide or N-methyl-N-phenylformamide and phosphorus oxychloride to carry out formylation, thereby synthesizing a benzaldehyde derivative (XVII), as shown by the formula (e):

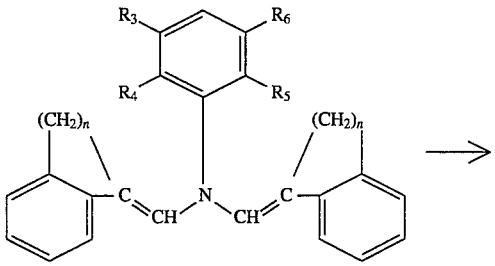

(XVI)

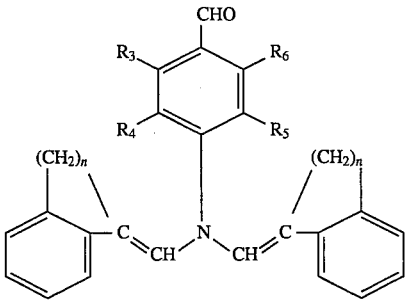

(XVII)

(e)

Next, the benzaldehyde derivative (XVII) is reacted with a hydrazine derivative (XI) in the presence of a catalyst, while heated in, for example, ethanol to synthesize the enamine derivative which is a desired compound (III), as shown by the formula (f):

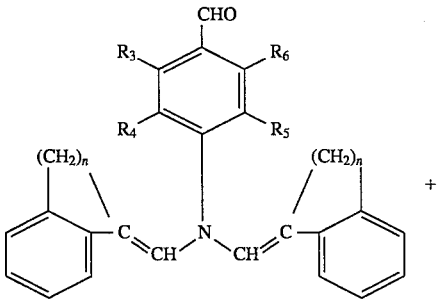

(XVII)

-continued

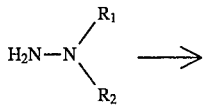

(XI)

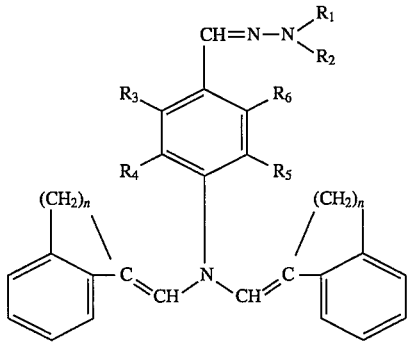

(III)

(f)

Examples of the above-mentioned catalyst include acetic acid and potassium acetate.

In the present invention, exemplary compounds shown in, for example, Tables 6 to 15 can be synthesized by the above-mentioned synthetic methods, and these exemplary compounds can each be used as the carrier transport material of the electrophotographic photoreceptor.

TABLE 6

($R_3$ and $R_6$ are hydrogen atoms, and n is 2)

| Exemplary Compound No. | $R_1$ | $R_2$ | $R_4$ | $R_5$ |
|---|---|---|---|---|
| 109 | 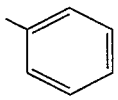 | $-CH_3$ | $-H$ | $-H$ |
| 110 | 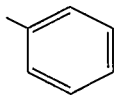 | $-C_2H_5$ | $-H$ | $-H$ |

TABLE 6-continued
($R_3$ and $R_6$ are hydrogen atoms, and n is 2)
| Exemplary Compound No. | $R_1$ | $R_2$ | $R_4$ | $R_5$ |
|---|---|---|---|---|
| 111 | 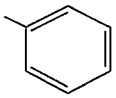 | 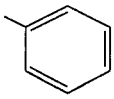 | −H | −H |
| 112 | 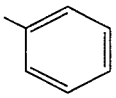 | 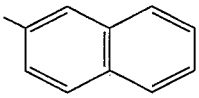 | −H | −H |
| 113 | 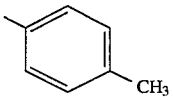 | 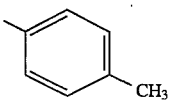 | −H | −H |
| 114 | 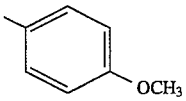 | 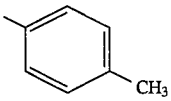 | −H | −H |
| 115 | 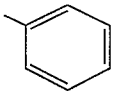 | 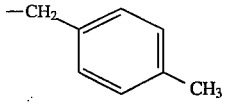 | −H | −H |
| 116 | 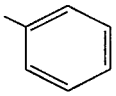 | 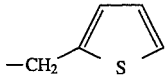 | −H | −H |
| 117 | 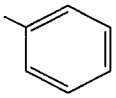 | $-CH_3$ | $-CH_3$ | −H |
| 118 | 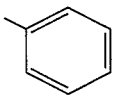 | 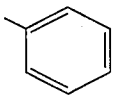 | $-CH_3$ | −H |
| 119 | 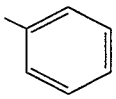 | 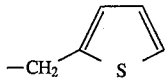 | $-CH_3$ | −H |
| 120 | 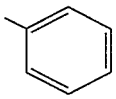 | $-CH_3$ | $-OCH_3$ | −H |
| 121 | 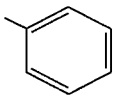 | 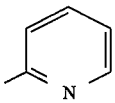 | −Cl | −H |
| 122 | 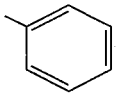 | $-CH_3$ | $-CH_3$ | −H |
| 123 | 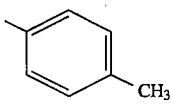 | $-nC_3H_7$ | $-C_2H_5$ | −H |
| 124 | 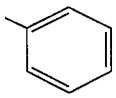 | $-CH_3$ | $-N(CH_3)_2$ | −H |

TABLE 6-continued
($R_3$ and $R_6$ are hydrogen atoms, and n is 2)
| Exemplary Compound No. | $R_1$ | $R_2$ | $R_4$ | $R_5$ |
|---|---|---|---|---|
| 125 | 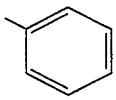 | $-nC_4H_9$ | $-CH_3$ | $-CH_3$ |
| 126 | 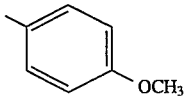 | $-CH_3$ | $-CF_3$ | $-H$ |
TABLE 7
($R_3$ and $R_6$ are hydrogen atoms, and n is 3)
| Exemplary Compound No. | $R_1$ | $R_2$ | $R_4$ | $R_5$ |
|---|---|---|---|---|
| 127 | 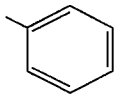 | $-CH_3$ | $-H$ | $-H$ |
| 128 | 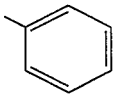 | $-C_2H_5$ | $-H$ | $-H$ |
| 129 | 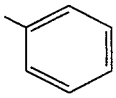 | $-nC_3H_7$ | $-H$ | $-H$ |
| 130 | 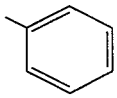 | 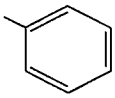 | $-H$ | $-H$ |
| 131 | 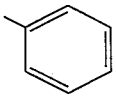 | 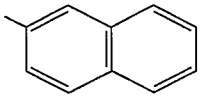 | $-H$ | $-H$ |
| 132 | 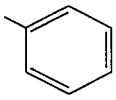 | 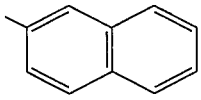 | $-H$ | $-H$ |
| 133 | 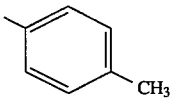 | 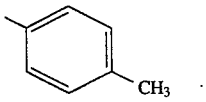 | $-H$ | $-H$ |
| 134 | 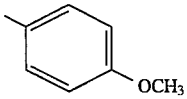 | 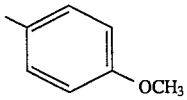 | $-H$ | $-H$ |
| 135 | 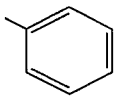 | 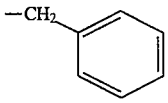 | $-H$ | $-H$ |
| 136 | 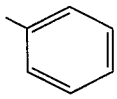 | 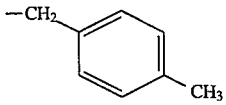 | $-H$ | $-H$ |

TABLE 7-continued
($R_3$ and $R_6$ are hydrogen atoms, and n is 3)
| Exemplary Compound No. | $R_1$ | $R_2$ | $R_4$ | $R_5$ |
|---|---|---|---|---|
| 137 | 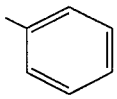 | 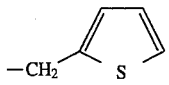 | −H | −H |
| 138 | 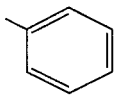 | 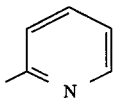 | −H | −H |
| 139 | 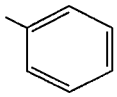 | $-CH_3$ | $-CH_3$ | −H |
| 140 | 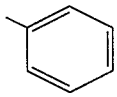 | 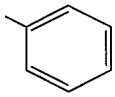 | $-CH_3$ | −H |
| 141 | 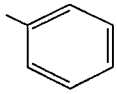 | $-C_2H_5$ | $-OCH_3$ | −H |
| 142 | 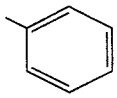 | $-CH_3$ | −Cl | −H |
| 143 | 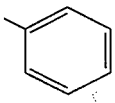 | 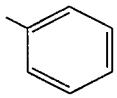 | $-CF_3$ | −H |
| 144 | 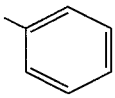 | $-CH_3$ | $-CH_3$ | $-CH_3$ |
TABLE 8
($R_3$ and $R_6$ are hydrogen atoms, and n is 4)
| Exemplary Compound No. | $R_1$ | $R_2$ | $R_4$ | $R_5$ |
|---|---|---|---|---|
| 145 | 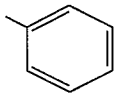 | $-CH_3$ | −H | −H |
| 146 | 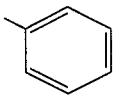 | $-C_2H_5$ | −H | −H |
| 147 | 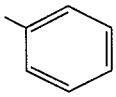 | 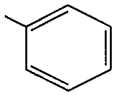 | −H | −H |
| 148 | 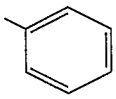 | 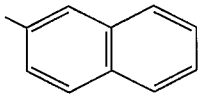 | −H | −H |

TABLE 8-continued
($R_3$ and $R_6$ are hydrogen atoms, and n is 4)
| Exemplary Compound No. | $R_1$ | $R_2$ | $R_4$ | $R_5$ |
|---|---|---|---|---|
| 149 | 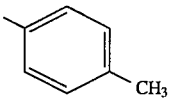 | 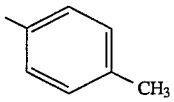 | −H | −H |
| 150 | 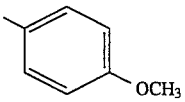 | 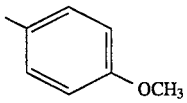 | −H | −H |
| 151 | 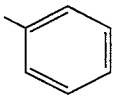 | 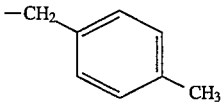 | −H | −H |
| 152 | 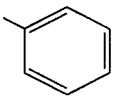 | 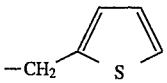 | −H | −H |
| 153 | 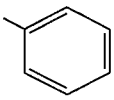 | 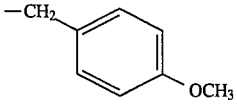 | −H | −H |
| 154 | 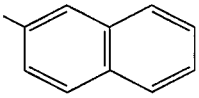 | $-CH_3$ | −H | −H |
| 155 | 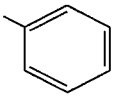 | $-CH_3$ | $-CH_3$ | −H |
| 156 | 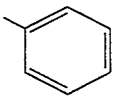 | 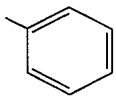 | $-CH_3$ | −H |
| 157 | 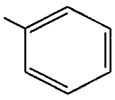 | $-CH_3$ | $-OCH_3$ | −H |
| 158 | 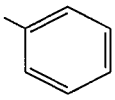 | $-C_2H_5$ | −Cl | −H |
| 159 | 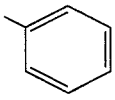 | $-CH_3$ | $-CH_3$ | $-CH_3$ |
| 160 | 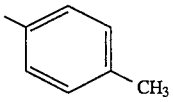 | 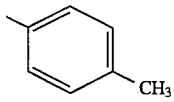 | $-CH_3$ | $-CH_3$ |
| 161 | 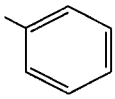 | $-CH_3$ | $-CF_3$ | −H |
| 162 | 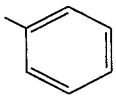 | $-CH_3$ | −F | −H |

TABLE 9
($R_3$, $R_4$, $R_5$ and $R_6$ are hydrogen atoms, and n is 3)
| Exemplary Compound No. | $R_1$ | $R_2$ |
|---|---|---|
| 163 | $-CH_3$ | 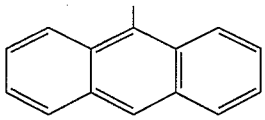 |
| 164 | $-CH_3$ | 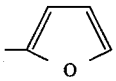 |
| 165 | $-CH_3$ | 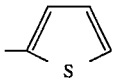 |
| 166 | $-CH_3$ | 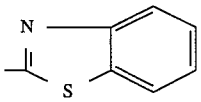 |
| 167 | $-CH_3$ | 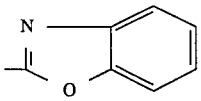 |
TABLE 10
($R_3$, $R_5$ and $R_6$ are hydrogen atoms)
| Exemplary Compound No. | 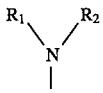 | $R_4$ | n |
|---|---|---|---|
| 168 | 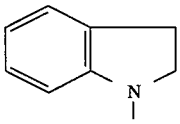 | $-H$ | 2 |
| 169 | 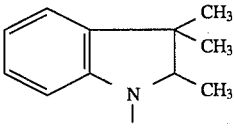 | $-H$ | 2 |
| 170 | 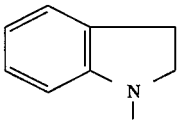 | $-CH_3$ | 2 |
| 171 | 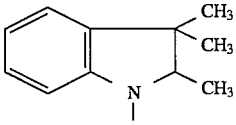 | $-C_2H_5$ | 2 |
TABLE 10-continued
($R_3$, $R_5$ and $R_6$ are hydrogen atoms)
| Exemplary Compound No. | 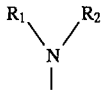 | $R_4$ | n |
|---|---|---|---|
| 172 | 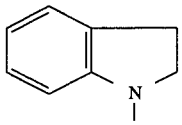 | $-Cl$ | 2 |
| 173 | 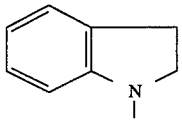 | $-CF_3$ | 2 |
| 174 | 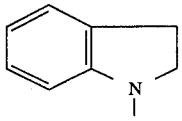 | $-nC_3H_7$ | 2 |
| 175 | 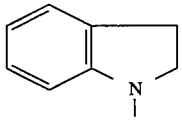 | $-N(CH_3)_2$ | 2 |
| 176 | 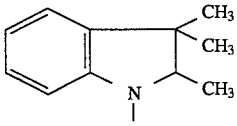 | $-N(CH_3)_2$ | 3 |
| 177 | 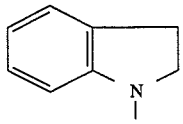 | $-H$ | 3 |
| 178 | 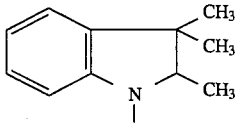 | $-H$ | 3 |
| 179 | 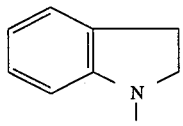 | $-CH_3$ | 3 |

TABLE 11
($R_6$ is a hydrogen atom)
| Exemplary Compound No. | 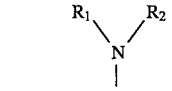 | $R_3$ | $R_4$ | $R_5$ | n |
|---|---|---|---|---|---|
| 180 | 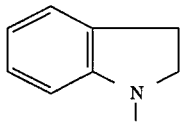 | −H | -n$C_3H_7$ | −H | 3 |
| 181 | 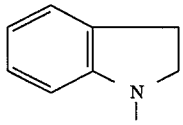 | −H | −$CF_3$ | −H | 3 |
| 182 | 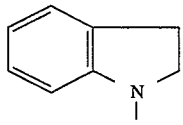 | −H | −Cl | −H | 3 |
| 183 | 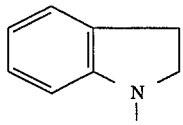 | −H | −$OCH_3$ | −H | 3 |
| 184 | 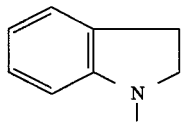 | −H | −$N(CH_3)_2$ | −H | 3 |
| 185 | 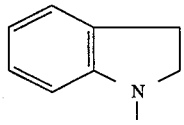 | −H | −$CH_3$ | −$CH_3$ | 3 |
| 186 | 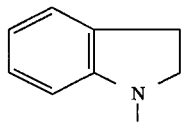 | −$CH_3$ | −H | −$CH_3$ | 3 |
| 187 | 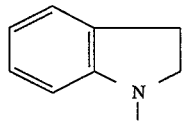 | −H | −H | −H | 4 |
| 188 | 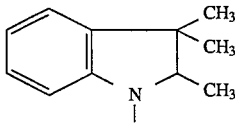 | −H | −H | −H | 4 |

TABLE 11-continued
($R_6$ is a hydrogen atom)
| Exemplary Compound No. | 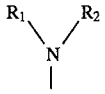 | $R_3$ | $R_4$ | $R_5$ | n |
|---|---|---|---|---|---|
| 189 | 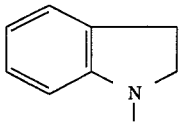 | −H | $-CH_3$ | −H | 4 |
| 190 | 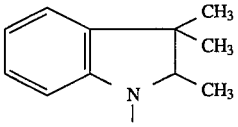 | −H | $-CH_3$ | −H | 4 |
| 191 | 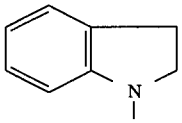 | −H | $-OCH_3$ | −H | 4 |
| 192 | 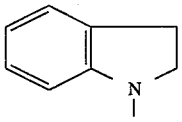 | −H | −Cl | −H | 4 |
| 193 | 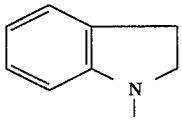 | −H | $-CH_3$ | −H | 4 |
| 194 | 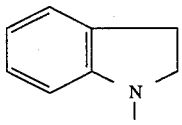 | −H | $-C_2H_6$ | −H | 4 |
TABLE 12
($R_3$ and $R_6$ are hydrogen atoms)
| Exemplary Compound No. | 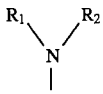 | $R_4$ | $R_5$ | n |
|---|---|---|---|---|
| 195 | 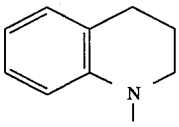 | −H | −H | 2 |
| 196 | 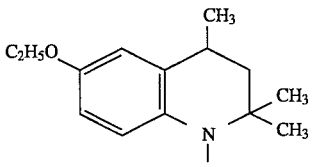 | −H | −H | 2 |

TABLE 12-continued
($R_3$ and $R_6$ are hydrogen atoms)
| Exemplary Compound No. | $R_1$ $R_2$ N | $R_4$ | $R_5$ | n |
|---|---|---|---|---|
| 197 | 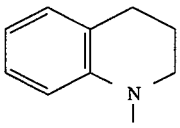 | $-CH_3$ | $-H$ | 2 |
| 198 | 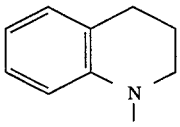 | $-OCH_3$ | $-H$ | 2 |
| 199 | 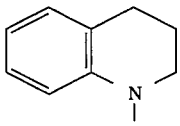 | $-nC_3H_7$ | $-H$ | 2 |
| 200 | 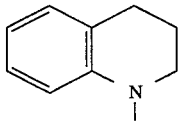 | $-H$ | $-H$ | 3 |
| 201 | 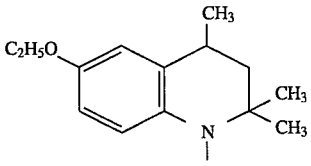 | $-H$ | $-H$ | 3 |
| 202 | 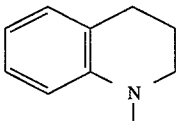 | $-C_2H_5$ | $-H$ | 3 |
| 203 | 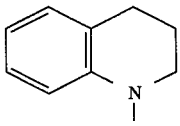 | $-CH_3$ | $-CH_3$ | 3 |
| 204 | 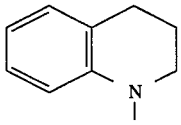 | $-H$ | $-H$ | 4 |
| 205 | 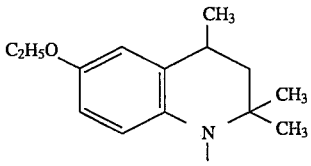 | $-H$ | $-H$ | 4 |

TABLE 12-continued
($R_3$ and $R_6$ are hydrogen atoms)
| Exemplary Compound No. | 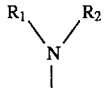 | $R_4$ | $R_5$ | n |
|---|---|---|---|---|
| 206 | 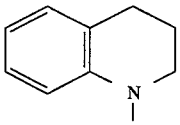 | $-CH_3$ | $-H$ | 4 |
| 207 | 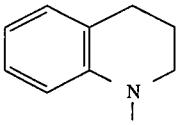 | $-OCH_3$ | $-H$ | 4 |
| 208 | 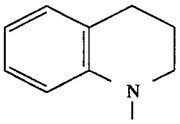 | $-F$ | $-H$ | 4 |
| 209 | 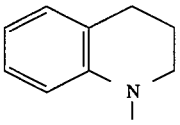 | $-C_2H_5$ | $-H$ | 4 |
TABLE 13
($R_3$, $R_4$, $R_5$ and $R_6$ are hydrogen atoms)
| Exemplary Compound No. | 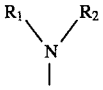 | n |
|---|---|---|
| 210 | 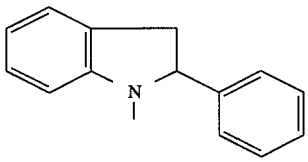 | 2 |
| 211 | 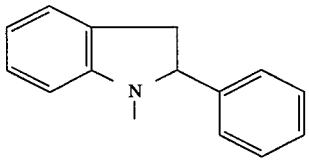 | 3 |
| 212 | 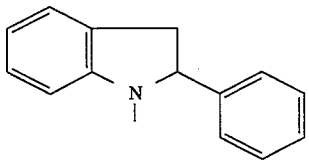 | 4 |
TABLE 14
($R_3$ and $R_6$ are hydrogen atoms)
| Exemplary Compound No. | 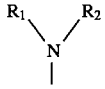 | $R_4$ | $R_5$ | n |
|---|---|---|---|---|
| 213 | 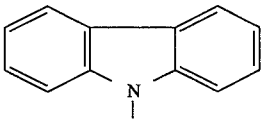 | $-H$ | $-H$ | 2 |
| 214 | 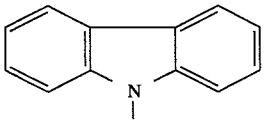 | $-CH_3$ | $-H$ | 2 |
| 215 | 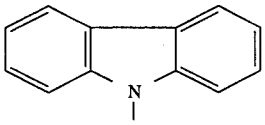 | $-H$ | $-H$ | 3 |
| 216 | 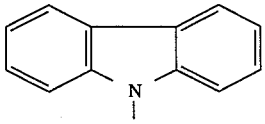 | $-CH_3$ | $-H$ | 3 |

TABLE 14-continued ($R_3$ and $R_6$ are hydrogen atoms)

| Exemplary Compound No. | 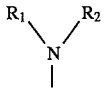 | $R_4$ | $R_5$ | n |
|---|---|---|---|---|
| 217 | 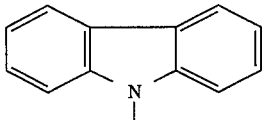 | −H | −H | 4 |
| 218 | 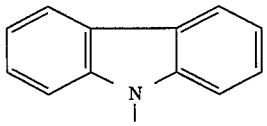 | $-CH_3$ | $-CH_3$ | 4 |

TABLE 15

($R_3$, $R_4$, $R_5$ and $R_6$ are hydrogen atoms)

| Exemplary Compound No. | 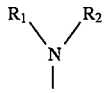 | n |
|---|---|---|
| 219 | 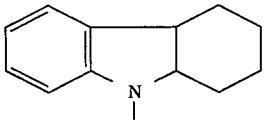 | 2 |
| 220 | 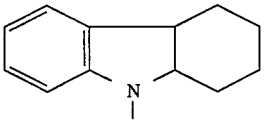 | 3 |
| 221 | 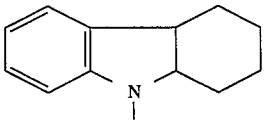 | 4 |

Among the above-mentioned exemplary compounds, the enamine derivative represented by the formula (III) in which one of $R_1$ and $R_2$ is a phenyl group and the other is a methyl group, a phenyl group or a thienylmethyl group, or $R_1$ and $R_2$ form

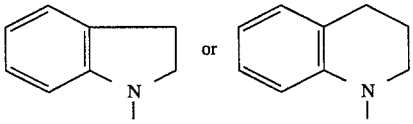

together with a nitrogen atom bonded thereto is preferable, because of excellent electrophotographic properties, a low manufacturing cost and easy synthesis thereof. However, the above-mentioned phenyl group, thienylmethyl group,

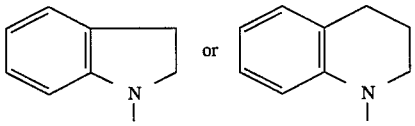

may have a substituent in place of a hydrogen atom. Examples of this substituent include a methyl group and a methoxy group.

In the present invention, the enamine derivative of the formula (III) can be used as the carrier transport material of the electrophotographic photoreceptor.

Still another preferable example of the enamine derivative represented by the formula (I) is an enamine derivative represented by the formula (IV)

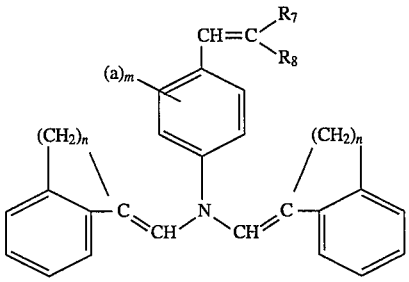

(IV)

wherein $R_7$ and $R_8$ are each a hydrogen atom (except a case where both of $R_7$ and $R_8$ are hydrogen atoms), an aryl group which may have a substituent, a heterocyclic group which may have a substituent, an aralkyl group which may have a substituent, a lower alkyl group or a heterocyclic alkyl group; a is a lower alkyl group, a lower alkoxy group, a halogen atom or a hydrogen atom; m is an integer of 1 to 4 (when m is 2 or more, a may be the same or different); and n is an integer of 2 to 4.

Examples of the substituent in the aryl group, the aralkyl group and the heterocyclic group represented by $R_7$ and $R_8$ in the formula (IV) include lower alkyl groups such as methyl and ethyl; lower alkoxy groups such as methoxy and ethoxy; amino groups such as methylamino, dimethylamino, ethylamino, ethylmethylamino and diethylamino; and halogen atoms such as fluorine, chlorine and bromine. It is preferable that each of the aryl group, the aralkyl group and the heterocyclic group has one or two of these substituents.

Examples of the aryl group include aromatic hydrocarbon residues having 6 to 14 carbon atoms, such as phenyl, naphthyl and anthryl.

Examples of the aralkyl group include phenyl-$C_{1-3}$ alkyl groups such as benzyl and phenethyl.

Examples of the heterocyclic group include a six-membered ring having one or two nitrogen atoms and a five-membered ring having one or two of oxygen atoms, nitrogen atoms or sulfur atoms. These heterocyclic groups may be condensed with a benzene ring. Examples of the heterocyclic groups include pyridyl, pyrimidinyl, furyl, pyrrolyl, thienyl, thiazolyl, oxazolyl, benzothiazolyl and benzoxazolyl.

Typical examples of "the aryl group which may have the substituent" represented by $R_7$ and $R_8$ include phenyl, p-tolyl, p-ethylphenyl, p-methoxyphenyl, p-ethoxyphenyl, p-chlorophenyl, p-fluorophenyl, 3,5-xylyl, 3,4-xylyl, 2,5-xylyl, p-dimethylaminophenyl, 1-naphthyl, 2-naphthyl, 2-methyl-1-naphthyl and 9-anthryl.

Typical examples of "the aralkyl group which may have the substituent" represented by $R_7$ and $R_8$ include benzyl, p-methylbenzyl, p-methoxybenzyl and p-chlorobenzyl, Typical examples of "the heterocyclic group which may have the substituent" represented by $R_7$ and $R_8$ include 2-benzothiazolyl, 2-benzoxazolyl, 2-pyridyl, 2-thienyl, 3-thienyl, 2-furyl and 3-furyl.

The lower alkyl groups represented by $R_7$ and $R_8$ are preferably alkyl groups having 1 to 5 carbon atoms, and typical examples of the lower alkyl groups include methyl, ethyl, n-propyl, i-propyl, n-butyl, sec-butyl and n-pentyl.

Typical examples of the heterocyclic alkyl group represented by $R_7$ and $R_8$ include 2-thienylmethyl, 2-furylmethyl, 3-furylmethyl, 2-pyridylmethyl, 2-benzothiazolylmethyl and 2-benzoxazolylmethyl.

The lower alkyl group represented by a is preferably an alkyl group having 1 to 5 carbon atoms, and typical examples thereof include methyl, ethyl, n-propyl, i-propyl, n-butyl, sec-butyl and n-pentyl.

The lower alkoxy group represented by a is preferably an alkoxy group having 1 to 5 carbon atoms, more preferably 1 to 3 carbon atoms, and typical examples thereof include methoxy, ethoxy, n-propoxy, i-propoxy, n-butoxy and n-pentoxy.

The enamine derivative represented by the formula (IV) of the present invention can be synthesized by various methods, for example, the following two methods.

That is to say, according to the first method, a 4-nitrobenzaldehyde derivative having an optional substituent represented by the following formula (XVIII) is reacted with a Wittig agent having an optional substituent represented by the following formula (XIX) in tetrahydrofuran and potassium tert-butoxide to obtain a styryl derivative represented by the formula (XX):

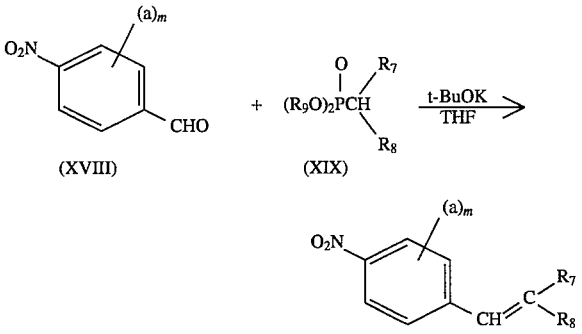

wherein $R_7$, $R_8$, a and m have the same meanings as in the formula (IV); and $R_9$ is a lower alkyl group or a phenyl group.

Next, this styryl derivative (XX) is subjected to a reducing reaction with the aid of iron in a mixed solvent of 1,4-dioxane and water in a catalyst such as acetic acid or hydrochloric acid to obtain an aniline derivative represented by the formula (XXI):

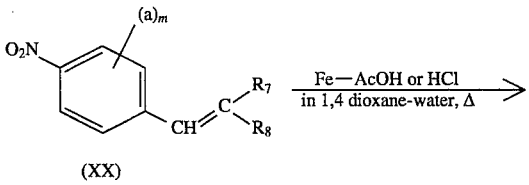

-continued

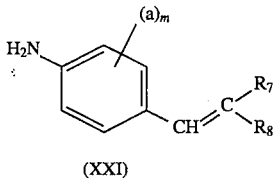

wherein m has the same meaning as in the formula (IV).

Next, this aniline derivative (XXI) is subjected to dehydration-condensation with an aldehyde compound represented by the following formula (XXII) in toluene in the presence of an acid catalyst to obtain the enamine derivative represented by the formula (IV) of the present invention:

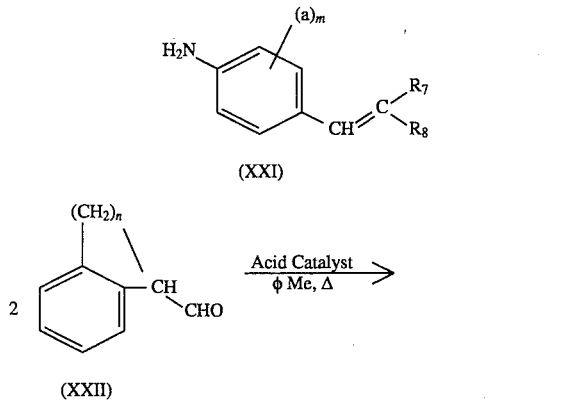

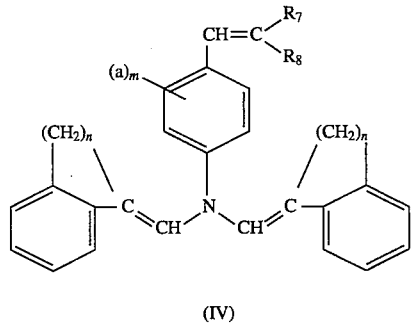

wherein n has the same meaning as in the formula (IV).

According to the second method, an aniline derivative having various substituents represented by the following formula (XXIII) is subjected to dehydration-condensation with an aldehyde compound represented by the following formula (XXII) in toluene in the presence of an acid catalyst to obtain an enamine derivative represented by the formula (XXIV):

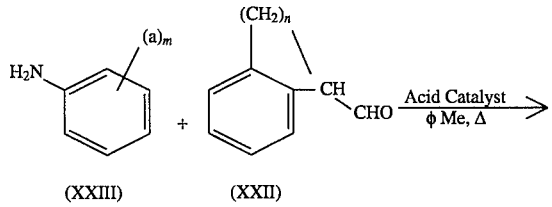

-continued

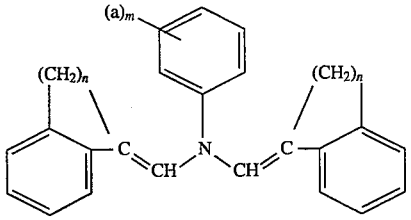

(XXIV)

wherein a, m and n have the same meanings as in the formula (IV).

Next, the enamine derivative represented by the formula (XXIV) is subjected to a formylation reaction with phosphorus oxychloride and N,N-dimethylformamide, N-methyl-N-phenylformamide or the like to obtain an aldehyde compound represented by the formula (XXV):

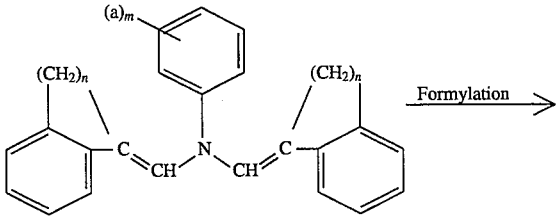

(XXIV)

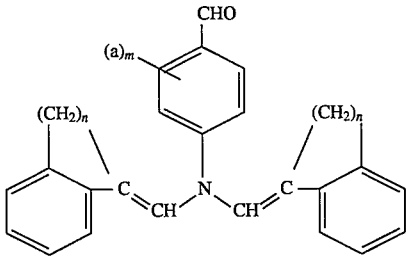

(XXV)

wherein a, m and n have the same meanings as in the formula (IV).

Next, this aldehyde compound (XXV) is reacted with a Wttig agent (XIX) having various substituents in tetrahydrofuran and potassium tert-butoxide to obtain the enamine derivative represented by the formula (IV) of the present invention:

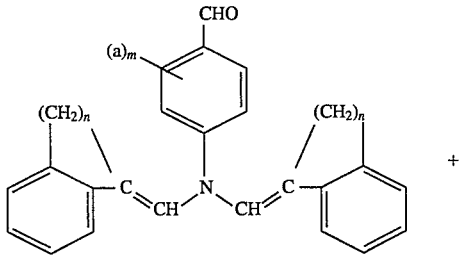

(XXV)

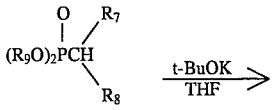

(XIX)

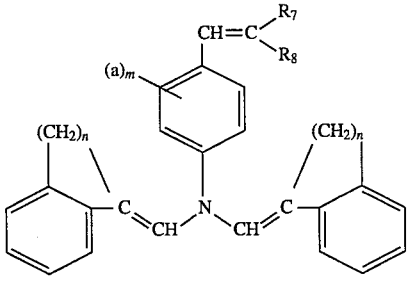

(IV)

wherein $R_9$ is the same meaning as mentioned above; and $R_7$ and $R_8$ have the same meanings as in the formula (IV).

In the present invention, for example, exemplary compounds shown in Tables 16 to 24 can be synthesized by the above-mentioned synthetic methods, and they can each be used as the carrier transport material of the electrophotographic photoreceptor.

TABLE 16

| Exemplary Compound No. | $(a)_m$ | $R_7$ | $R_8$ | n |
|---|---|---|---|---|
| 222 | H | 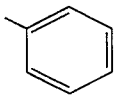 | $CH_3$ | 2 |
| 223 | H | 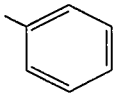 | $C_2H_5$ | 2 |
| 224 | H | 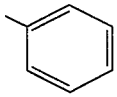 | n-$C_3H_7$ | 2 |
| 225 | H | 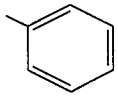 | 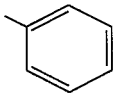 | 2 |

TABLE 16-continued
| Exemplary Compound No. | $(a)_m$ | $R_7$ | $R_8$ | n |
|---|---|---|---|---|
| 226 | H | 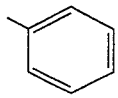 | H | 2 |
| 227 | H | 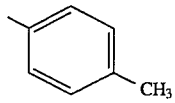 | H | 2 |
| 228 | H | 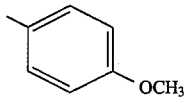 | H | 2 |
| 229 | H | 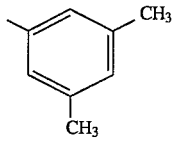 | H | 2 |
| 230 | H | 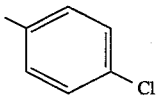 | H | 2 |
| 231 | H | 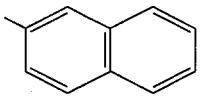 | H | 2 |
| 232 | H | 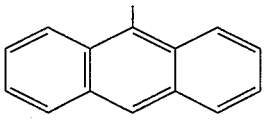 | H | 2 |
| 233 | H | 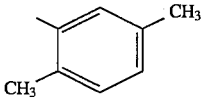 | H | 2 |
| 234 | H | 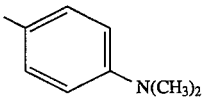 | H | 2 |
TABLE 17
| Exemplary Compound No. | $(a)_m$ | $R_7$ | $R_8$ | n |
|---|---|---|---|---|
| 235 | H | 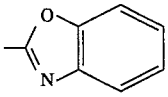 | H | 2 |
| 236 | H | 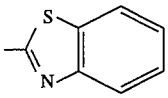 | H | 2 |
| 237 | H | 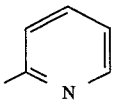 | H | 2 |

TABLE 17-continued
| Exemplary Compound No. | $(a)_m$ | $R_7$ | $R_8$ | n |
|---|---|---|---|---|
| 238 | H | 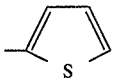 | H | 2 |
| 239 | H | 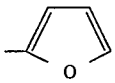 | H | 2 |
| 240 | 3-$CH_3$ | 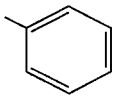 | H | 2 |
| 241 | 3-$CH_3$ | 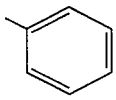 | 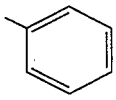 | 2 |
| 242 | 3-$CH_3$ | 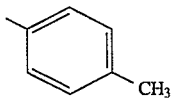 | H | 2 |
| 243 | 3-$C_2H_5$ | 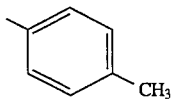 | 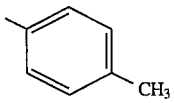 | 2 |
| 244 | 3-n$C_3H_7$ | 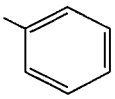 | H | 2 |
| 245 | 3-Cl | 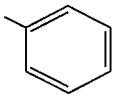 | H | 2 |
| 246 | 3-$OCH_3$ | 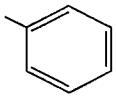 | H | 2 |
| 247 | 3-$CH_3$<br>5-$CH_3$ | 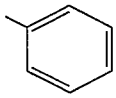 | H | 2 |
TABLE 18
| Exemplary Compound No. | $(a)_m$ | $R_7$ | $R_8$ | n |
|---|---|---|---|---|
| 248 | 3-$CH_3$<br>3-Cl | 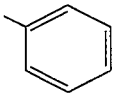 | H | 2 |
| 249 | H | 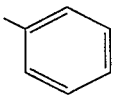 | 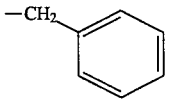 | 2 |
| 250 | H | 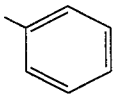 | 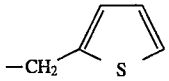 | 2 |

TABLE 18-continued
| Exemplary Compound No. | $(a)_m$ | $R_7$ | $R_8$ | n |
|---|---|---|---|---|
| 251 | H | 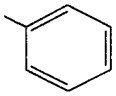 | —$CH_2$ 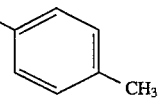 $CH_3$ | 2 |
| 252 | H | 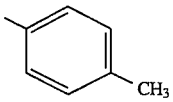 $CH_3$ | 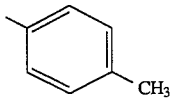 $CH_3$ | 2 |
| 253 | 3-$CF_3$ | 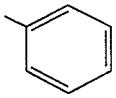 | H | 2 |
| 254 | 3-$CF_3$ | 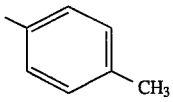 $CH_3$ | H | 2 |
| 255 | 3-F | 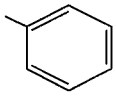 | H | 2 |
| 256 | 3-F | 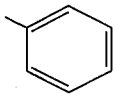 | 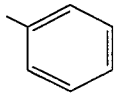 | 2 |
| 257 | 3-F | 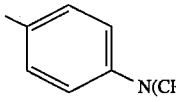 $N(CH_3)_2$ | H | 2 |
| 258 | H | 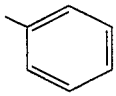 | H | 3 |
| 259 | H | 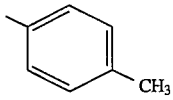 $CH_3$ | H | 3 |
| 260 | H | 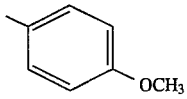 $OCH_3$ | H | 3 |
TABLE 19
| Exemplary Compound No. | $(a)_m$ | $R_7$ | $R_8$ | n |
|---|---|---|---|---|
| 261 | H | 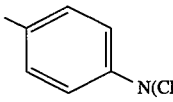 $N(CH_3)_2$ | H | 3 |
| 262 | H | 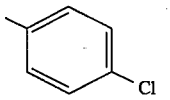 Cl | H | 3 |
TABLE 19-continued
| Exemplary Compound No. | $(a)_m$ | $R_7$ | $R_8$ | n |
|---|---|---|---|---|
| 263 | H | 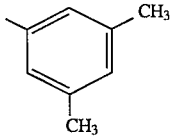 $CH_3$ $CH_3$ | H | 3 |
| 264 | H | 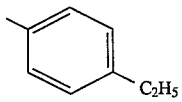 $C_2H_5$ | H | 3 |

TABLE 19-continued
| Exemplary Compound No. | $(a)_m$ | $R_7$ | $R_8$ | n |
|---|---|---|---|---|
| 265 | H | 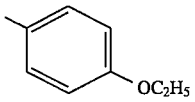 | H | 3 |
| 266 | H | 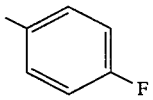 | H | 3 |
| 267 | H | 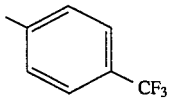 | H | 3 |
| 268 | H | 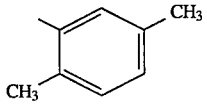 | H | 3 |
| 269 | H | 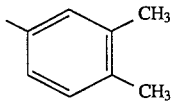 | H | 3 |
| 270 | H | 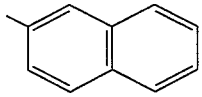 | H | 3 |
| 271 | H | 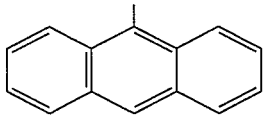 | H | 3 |
| 272 | H | 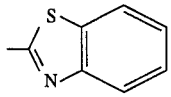 | H | 3 |
TABLE 20
| Exemplary Compound No. | $(a)_m$ | $R_7$ | $R_8$ | n |
|---|---|---|---|---|
| 273 | H | 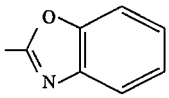 | H | 3 |
| 274 | H | 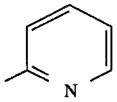 | H | 3 |
TABLE 20-continued
| Exemplary Compound No. | $(a)_m$ | $R_7$ | $R_8$ | n |
|---|---|---|---|---|
| 275 | H | 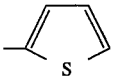 | H | 3 |
| 276 | H | 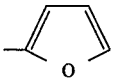 | H | 3 |
| 277 | H | 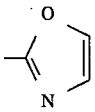 | H | 3 |
| 278 | H | 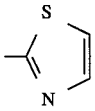 | H | 3 |
| 279 | H | 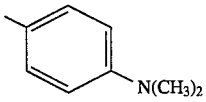 | $CH_3$ | 3 |
| 280 | H | 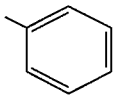 | 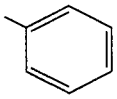 | 3 |
| 281 | 3-$CH_3$ | 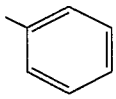 | H | 3 |
| 282 | 3-$CH_3$ | 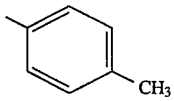 | H | 3 |
| 283 | 3-$OCH_3$ | 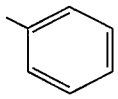 | H | 3 |
| 284 | 3-Cl | 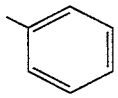 | H | 3 |

TABLE 21
| Exemplary Compound No. | $(a)_m$ | $R_7$ | $R_8$ | n |
|---|---|---|---|---|
| 285 | 3-F | 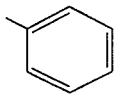 | H | 3 |
| 286 | 3-$C_2H_5$ | 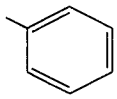 | H | 3 |
| 287 | 3-$CH_3$<br>5-$CH_3$ | 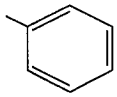 | H | 3 |
| 288 | 3-$CH_3$ | 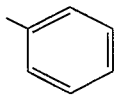 | 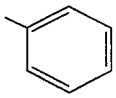 | 3 |
| 289 | 3-$CH_3$ | 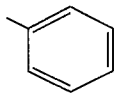 | $CH_3$ | 3 |
| 290 | 3-$CH_3$ | 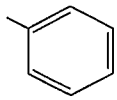 | $-CH_2$ 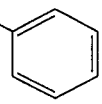 | 3 |
| 291 | 3-$CF_3$ | 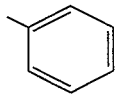 | H | 3 |
| 292 | 3-$CF_3$ | 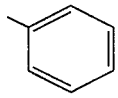 | $CH_3$ | 3 |
| 293 | 3-$CF_3$ | 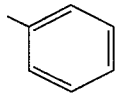 | 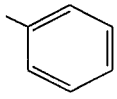 | 3 |
| 294 | H | 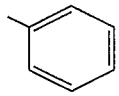 | H | 4 |
| 295 | H | 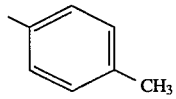 $CH_3$ | H | 4 |
| 296 | H | 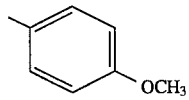 $OCH_3$ | H | 4 |
| 297 | H | 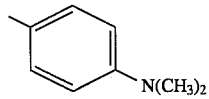 $N(CH_3)_2$ | H | 4 |
| 298 | H | 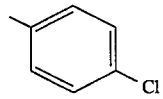 Cl | H | 4 |

TABLE 22
| Exemplary Compound No. | $(a)_m$ | $R_7$ | $R_8$ | n |
|---|---|---|---|---|
| 299 | H | 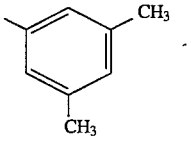 | H | 4 |
| 300 | H | 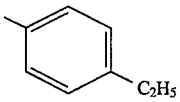 | H | 4 |
| 301 | H | 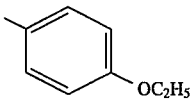 | H | 4 |
| 302 | H | 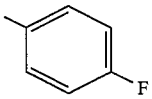 | H | 4 |
| 303 | H | 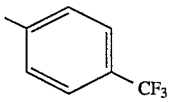 | H | 4 |
| 304 | H | 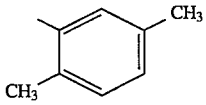 | H | 4 |
| 305 | H | 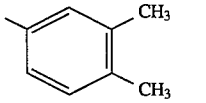 | H | 4 |
| 306 | H | 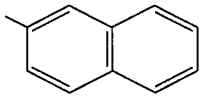 | H | 4 |
| 307 | H | 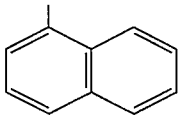 | H | 4 |
| 308 | H | 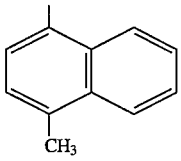 | H | 4 |
| 309 | H | 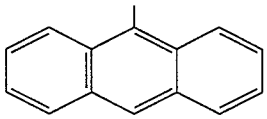 | H | 4 |
| 310 | H | 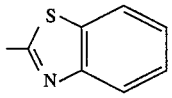 | H | 4 |
TABLE 23
| Exemplary Compound No. | $(a)_m$ | $R_7$ | $R_8$ | n |
|---|---|---|---|---|
| 311 | H | 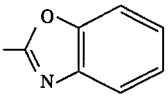 | H | 4 |
| 312 | H | 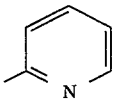 | H | 4 |
| 313 | H | 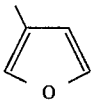 | H | 4 |
| 314 | H | 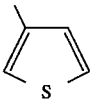 | H | 4 |
| 315 | H | 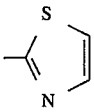 | H | 4 |
| 316 | H | 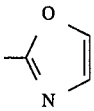 | H | 4 |
| 317 | H | 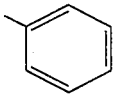 | $-CH_3$ | 4 |
| 318 | H | 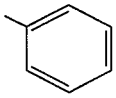 | 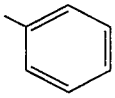 | 4 |
| 319 | 3-$CH_3$ | 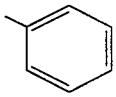 | H | 4 |
| 320 | 3-$CH_3$ | 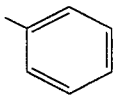 | $-CH_3$ | 4 |
| 321 | 3-$CH_3$ | 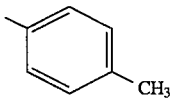 | H | 4 |
| 322 | 3-$OCH_3$ | 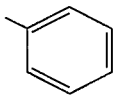 | H | 4 |
| 323 | 3-$OCH_3$ | 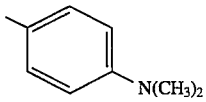 | H | 4 |

TABLE 23-continued

| Exemplary Compound No. | $(a)_m$ | $R_7$ | $R_8$ | n |
|---|---|---|---|---|
| 324 | 3-Cl | 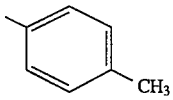 | H | 4 |
| 325 | 3-Cl | 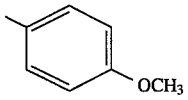 | H | 4 |

TABLE 24

| Exemplary Compound No. | $(a)_m$ | $R_7$ | $R_8$ | n |
|---|---|---|---|---|
| 326 | 3-F | 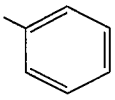 | H | 4 |
| 327 | 3-F | 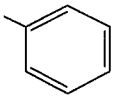 | 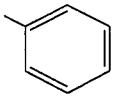 | 4 |

Among the compounds of the above-mentioned formula (IV), preferable are a compound represented by the formula (V)

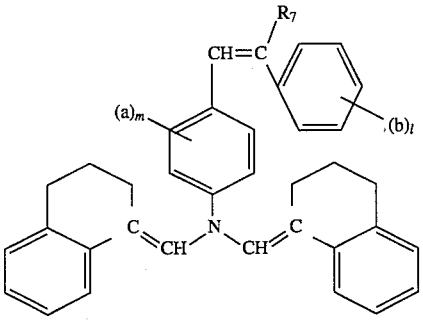

(V)

wherein b is a halogen atom, a hydrogen atom, an alkyl group having 1 to 5 carbon atoms, an alkoxy group having 1 to 3 carbon atoms or a dialkylamino group having 1 to 3 carbon atoms; and l is an integer of 1 to 5 (when l is 2 or more, b may be the same or different), a compound represented by the formula (VI)

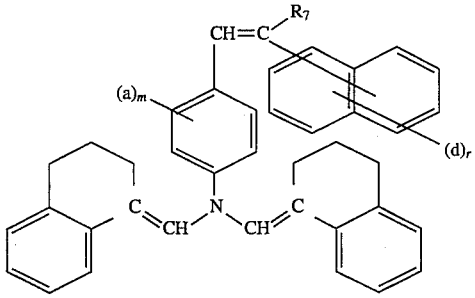

(VI)

wherein d is a halogen atom, a hydrogen atom, an alkyl group having 1 to 5 carbon atoms, an alkoxy group having 1 to 3 carbon atoms or a dialkylamino group having 1 to 3 carbon atoms; and r is an integer of 1 to 7 (when r is 2 or more, d may be the same or different), and a compound represented by the formula (VII)

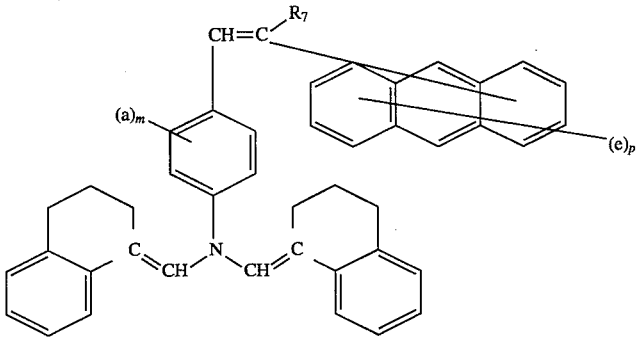

(VII)

wherein e is a halogen atom, a hydrogen atom, an alkyl group having 1 to 5 carbon atoms, an alkoxy group having 1 to 3 carbon atoms or a dialkylamino group having 1 to 3 carbon atoms; and p is an integer of 1 to 9 (when p is 2 or more, e may be the same or different).

Typical examples of the alkyl groups having 1 to 5 carbon atoms represented by "b", "d" or "e" include methyl, ethyl, n-propyl, i-propyl, n-butyl, sec-butyl and n-pentyl.

Typical examples of the alkoxy groups having 1 to 3 carbon atoms represented by "b", "d" or "e" include methoxy, ethoxy and propoxy.

Among these exemplary compounds, what is particularly excellent from the viewpoints of electrophotographic properties, cost and a synthetic procedure is a compound in which one of $R_7$ and $R_8$ is a hydrogen atom, the other is a phenyl group, a p-tolyl group, a p-methoxyphenyl group, a p-dimethylaminophenyl group or a 1-naphthyl group, or both of $R_7$ and $R_8$ are a phenyl group; "a" is a hydrogen atom or an electron donative group which is, for example, an alkyl group such as methyl, ethyl, n-propyl, i-propyl, n-butyl, sec-butyl or n-pentyl; or an alkoxy group such as methoxy, ethoxy, n-propoxy, i-propoxy, n-butoxy or n-pentoxy.

In the present invention, the enamine derivative represented by the formula (IV) can be used as the carrier transport material of the electrophotographic photoreceptor.

The electrophotographic photoreceptor of the present invention can be formed by laminating the photosensitive layer on the conductive support.

The conductive support has the function of transporting carriers (electrons or positive holes) which are produced by applying an electric field to the photosensitive layer formed thereon and then causing the photosensitive layer to absorb light, and as the conductive support, a conductive material having a shape such as a drum, a plate or a sheet can be used. As this conductive material, a metal, carbon, or a paper or a plastic film subjected to a conductive treatment can be used. Examples of the metal are copper and aluminum; an example of the paper subjected to the conductive treatment is a paper in which a carbon material is dispersed; an example of the plastic film subjected to the conductive treatment is a polyester film on which aluminum is vapor-deposited.

The above-mentioned photosensitive layer has the function of forming a latent image (an electrostatic latent image) comprising a two-dimensional distribution of electrostatic charges, and it is constituted of a carrier generation material and a carrier transport material. Furthermore, some additives can be added to the photosensitive layer, and examples of the additives include a film-formable binder, a spectral sensitizer, an electrical property deterioration inhibitor, an antioxidant, a curl inhibitor and a leveling agent.

The above-mentioned carrier generation material has the function of generating the carriers by absorbing light, and as the carrier generation material, a photosensitive pigment or dye can be used. Above all, the photosensitive pigment is preferable. Examples of the photosensitive pigment include phthalocyanine pigments such as metallic phthalocyanines, metal-free phthalocyanines and metal-free halogenated phthalocyanines; perylenic acid pigments such as perylene-imide and perylenic anhydride; azo pigments such as bis-azo pigments and tris-azo pigments; quinacridone pigments; and anthraquinone pigments. In particular, when the metal-free phthalocyanine pigment, a titanylphthalocyanine pigment, fluorenilidene, a bis-azo pigment having a fluorenone ring, a bis-azo pigment comprising an aromatic amine or a tris-azo pigment is used as the pigment for generating the carriers, the excellent electrophotographic photoreceptor having a high sensitivity can be obtained.

Examples of the photosensitive dye include triphenylmethane dyes such as Methyl Violet, Crystal Violet, Night Blue and Victoria Blue; acridine dyes such as erythrosine, Rhodamine B, Rhodamine 3R, Acridine Orange and flapeosine; thiazine dyes such as Methylene Blue and Methylene Green; oxazine dyes such as Capry Blue and Merdla Blue; cyanine dyes; styryl dyes; pyrylium salt dyes and thiopyrylium salt dyes. These dyes may be used singly, but when the dyes are used together with the above-mentioned pigments, carriers can often be generated in a higher efficiency.

When the photosensitive layer contains one or more kinds of compounds represented by the formula (I) as the carrier transport material, the obtained electrophotographic photoreceptor of the present invention can exert an extremely high performance. In addition, examples of the other carrier transport materials which can be contained in the photosensitive layer include styryl compounds such as β-phenyl-[4-(dibenzylamino)]stilbene, β-phenyl-[4-(N-ethylphenylamino)]stilbene and 1,1-bis(4-diethylaminophenyl)-4,4-diphenylbutadiene; hydrazone compounds such as 4-(dibenzylamino,)benzaldehyde-N,N-diphenylhydrazone, 4-(ethylphenylamino)benzaldehyde-N,N-diphenylhydrazone, 4-di(p-tolylamino)benzaldehyde-N,N-diphenylhydrazone and 3,3-bis[(4'-diethylamino)phenyl]acrolein-N,N-diphenylhydrazone; and triphenylamine compounds such as 4-methoxy-4'-(4-methoxystyryl)triphenylamine and 4-methoxy-4'-styryltriphenylamine.

The enamine derivative represented by the formula (I) in the photoreceptor of the present invention or the carrier transport material can be applied in the form of a film onto the conductive support with the aid of a binder resin having a film-formable ability.

In this case, in order to further increase the sensitivity, it is desirable that a material for imparting plasticity is added to the above-mentioned carrier generation material and the binder resin to form the uniform photosensitive film.

As the various kinds of binder resins having the film-formable ability, a suitable one can be selected in compliance with its utilization field.

That is to say, in the field of the photoreceptor for copying machines or printers, examples of the preferable binder resin include polystyrenes, polyvinyl acetals, polysulfones, polycarbonates, polyphenylene oxides, polyesters, alkyd resins and polyacrylates. They may be used singly or in the form of a mixture of two or more thereof. Above all, polystyrenes, polycarbonates, polyacrylates and polyphenylene oxides are preferable, because they have a volume resistance of $10^{13}$ Ω or more and are excellent in coating properties and potential properties.

The amount of the binder resins to be added is 0.2 to 20 times, preferably 0.5 to 5 times that of the enamine derivative represented by the formula (I) in weight. If the amount of the binder resins to be added is less than 0.2 times that of the enamine derivative in weight, a compound precipitates on the surface of the photoreceptor inconveniently, and if it is more than 20 times, the sensitivity deteriorates noticeably.

In order to use the photoreceptor as a printing plate, an alkaline binder is particularly necessary. This alkaline binder is a high-molecular material having an acid group, for example, an acid anhydride group, a carboxyl group, a phenolic hydroxyl group, a sulfonic group, a sulfonamide group or a sulfonimide group, and the high-molecular material is soluble in an aqueous or alcoholic alkaline solvent (inclusive of a mixed solvent).

This alkaline binder preferably has a high acid value of 100 or more.

The high-molecular material, i.e., the binder resin having the high acid value is easily soluble or easily swells in an alkaline solvent. Examples of the binder resins include styrene-maleic anhydride copolymer, vinyl acetate-maleic anhydride copolymer, vinyl acetate-crotonic acid copolymer, methacrylic acid-methacrylate copolymer, phenolic resin, methacrylic acid-styrene copolymer, styrene-methacrylate copolymer and methacrylic acid-styrene-methacrylate copolymer.

In order to increase the sensitivity, it is preferable that a material capable of imparting plasticity is added to the binder for the film formation to form a uniform photosensitive film. Examples of the material capable of imparting plasticity include phthalates (e.g., DOP and DBP), phosphates (e.g., TCP and TOP), adipates, nitrile rubbers and chlorinated hydrocarbons.

As the above-mentioned spectral sensitizer which can be added to the photosensitive layer, for example, a sensitizing dye and the like can be used. Examples of the sensitizing dyes include triphenylmethane dyes such as Methyl Violet, Crystal Violet, Night Blue and Victoria Blue; acridine dyes such as erythrosine, Rhodamine B, Rhodamine 3R, Acridine Orange and flapeosine; thiazine dyes such as Methylene Blue and Methylene Green; oxazine dyes such as Capry Blue and Merdla Blue; cyanine dyes; styryl dyes; pyrylium salt dyes and thiopyrylium salt dyes.

The above-mentioned electrical property deterioration inhibitor can inhibit an increase in a residual potential as well as deteriorations such as a decrease in a charging potential and a decrease in sensitivity. Examples of the electrical property deterioration inhibitors which can be added to the photosensitive layer include electron attractive compounds such as tribenzylamine, tetrabenzyl-p-xylenediamine, 1-chloroanthraquinone, benzoquinone, 2,3-dichloronaphthoquinone, naphthoquinone, 4,4'-dinitrobenzophenone, 4,4'-dichlorobenzophenone, 4-nitrobenzophenone, 4-nitrobenzalmalondinitrile, ethyl α-cyano-β-(p-cyanophenyl)acrylate, 9-anthracenylmethylmalondinitrile, 1-cyano-1-(p-nitrophenyl)-2-(p-chlorophenyl)ethylene and 2,7-dinitrofluorenone.

Examples of the antioxidant include BHT and BHQ.

An example of the leveling agent is silicone oil.

In the present invention, the enamine derivative represented by the formula (I) is dissolved or dispersed in a suitable solvent together with the above-mentioned various kinds of additives in compliance with the morphology of the desired photoreceptor to form a coating solution, and then applying the coating solution onto the above-mentioned conductive support, followed by drying, to prepare the photoreceptor of the present invention.

Examples of the solvents for the application include aromatic hydrocarbons such as benzene, toluene, xylene and monochlorobenzene; dioxane, dimethoxy methyl ether, dimethylformamide and methylene chloride, and they can be used singly or in the form of a mixed solvent of two or more thereof. If necessary, a solvent such as an alcohol, acetonitrile or methyl ethyl ketone can be further added to the coating solvent.

In the photoreceptor of the present invention, the enamine derivative can be used in various manners.

For example, the carrier generation material and the electron attractive compound are added to the enamine derivative as the carrier transport material, and the mixture is then dissolved or dispersed in the binder resin. Afterward, the resultant coating solution is applied as a photosensitive layer onto the conductive support to obtain the photoreceptor.

Furthermore, there can be prepared the photosensitive layer having a laminate structure which comprises the carrier generation layer having a high electric charge generation efficiency and the carrier transport layer. That is to say, the enamine derivative is dissolved or dispersed in the binder resin, if necessary, together with the antioxidant compound and the electron attractive compound, and the resultant coating solution is then applied as the carrier transport layer onto the carrier generation layer mainly comprising the (sensitizing) dye or pigment to form the photosensitive layer. Next, this photosensitive layer is laminated on the conductive support to obtain the desired photoreceptor.

An embodiment of the electrophotographic photoreceptor of the present invention will be schematically described in more detail with reference to FIGS. 1 to 6 attached thereto.

FIG. 1 shows the constitution of a double-layered photoconductive structure comprising a conductive support (1) and a photosensitive layer (4), and this photoconductive layer (4) comprises a laminate of a carrier generation layer (5) formed by dispersing a carrier generation material (2) as a main component in a binder, and a carrier transport layer (6) formed by dispersing a carrier transport material (3) as a main component in the binder. That is to say, FIG. 1 shows the constitution of the photoreceptor in which the carrier transport layer (6) is formed on the surface of the carrier generation layer (5), and the enamine derivative of the present invention is used as the carrier transport material (3) in the carrier transport layer (6).

Figure 2:
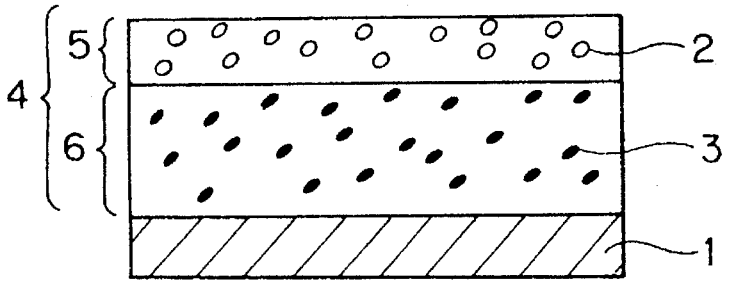
FIG. 2 is a sectional view schematically showing a layer constitution opposite to that of the laminated electrophotographic photoreceptor in FIG. 1.

FIG. 2 shows the constitution of a double-layered photoconductive structure comprising a laminate of the same carrier generation layer (5) and the same carrier transport layer (6) as in the photoreceptor in FIG. 1. However, in contrast to the photoconductive structure in FIG. 1, the carrier generation layer (5) is formed on the surface of the carrier transport layer (6), and in this carrier transport layer (6), the enamine derivative of the present invention is used as the carrier transport material (3).

Figure 3:
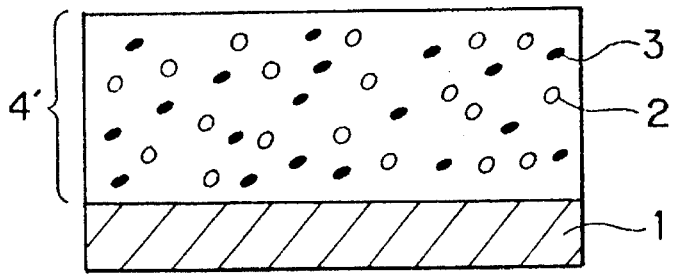
FIG. 3 is a sectional view schematically showing an electrophotographic photoreceptor in which the photosensitive layer is a single layer.

FIG. 3 shows the constitution of a single-layered photoconductive structure comprising the conductive support (1) and a photoconductive layer (4'), and this photoconductive layer (4') comprises a single layer formed by dispersing the carrier generation material (2) and the carrier transport material (3) in the binder.

Figure 4:
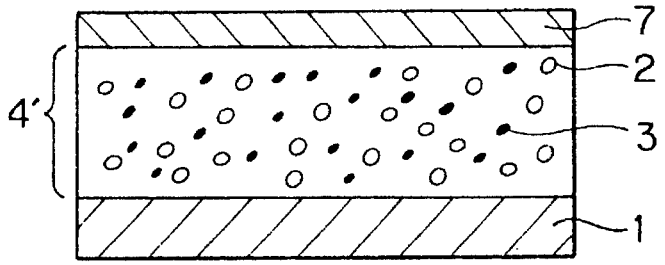
FIG. 4 is a sectional view schematically showing an electrophotographic photoreceptor in which a surface protective layer is formed on the photosensitive layer of FIG. 3.

FIG. 4 shows the constitution of a single-layered photoconductive structure comprising the photoreceptor shown in FIG. 3 and a surface protective layer (7) formed thereon.

Figure 5:
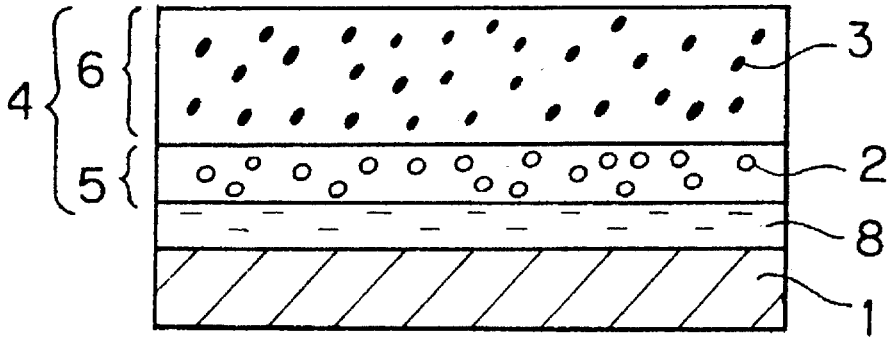
FIG. 5 is a sectional view schematically showing an electrophotographic photoreceptor in which an intermediate layer is formed between the photosensitive layer of FIG. 1 and a conductive support.

FIG. 5 shows constitution of a double-layered photoconductive structure comprising a laminate of the conductive support (1), the same photoconductive layer (4) as in FIG. 1, and an intermediate layer (8) formed therebetween.

Figure 6:
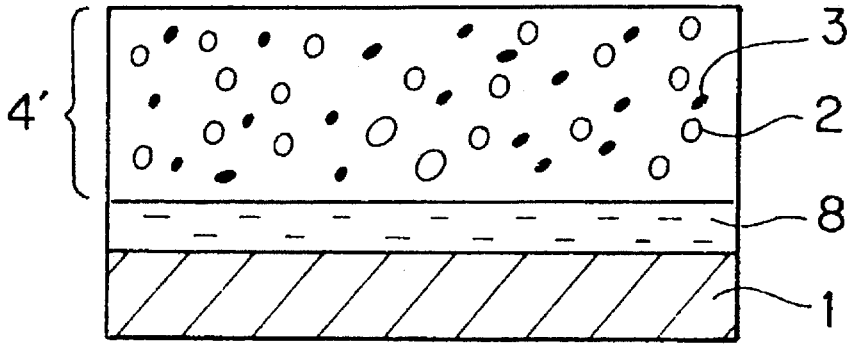
FIG. 6 is a sectional view schematically showing an electrophotographic photoreceptor in which the intermediate layer is formed between the photosensitive layer of FIG. 3 and the conductive support.

FIG. 6 shows the constitution of a single-layered photoconductive structure comprising the conductive support (1), the same photoconductive layer (4') as in FIG. 3, and the intermediate layer (8) formed therebetween.

The surface protective layer (7) formed on the surface of the photosensitive layer (4) is formed for the purposes of improving durability to mechanical stress and accepting and holding the electric charges generated by corona discharge in the dark. Furthermore, the surface protective layer (7) is made from a chemically stable material and is required to transmit light which the carrier generation layer receives. Thus, at the time of exposure, the surface protective layer (7) transmits the light and allows it to reach to the carrier generation layer, and the surface protective layer (7) is required to receive the generated electric charges to neutralize and extinguish the surface electric charges. In addition, the surface protective layer (7) is required to be as transparent as possible in a wavelength region having a light absorption maximum of the carrier generation material.

Examples of a suitable material for the surface protective layer (7) having such characteristics include organic insulating coating formation materials such as acrylic resin, polyaryl, polycarbonate and urethane resin; these organic insulating coating formation materials in which a low-resistance compound such as tin oxide or indium oxide is dispersed; modified silicone resins such as an acryl-modified silicone resin, an epoxy-modified silicone resin, an alkyd-modified silicone resin, a polyester-modified silicone resin and an urethane-modified silicone resin; a silicone resin as a hard coating agent; and mixed materials which contain silicon oxide, titanium oxide, indium oxide or zirconium oxide as a main component and a condensate of a silicone resin and a metallic alkoxy compound capable of forming a coating film for the purpose of further improving the durability. In addition, as the surface protective layer, an organic plasma polymer film can also be used, and if necessary, oxygen, nitrogen, a halogen, or an atom in the group III or V of the periodic table can be mixed with the organic plasma polymer film. It is also possible to form the surface protective layer from an inorganic material such as a metal or a metal oxide in accordance with vapor deposition, sputtering or the like. The thickness of the surface protective layer is in the range of 0.1 to 5 μm, preferably 0.5 to 2 μm.

The intermediate layer (8) formed between the conductive support (1) and the photoconductive layer (4) is formed with the intention of imparting a protective function and an adhesion function so as to enhance coating properties and to improve the transport of the electric charges of from the substrate to the photosensitve layer. Examples of a suitable material for the intermediate layer (8) include casein, polyvinyl butyral, polyvinyl alcohol, nitrocellulose, ethylene-acrylic acid copolymer, polyamides (nylon-6, nylon-6,6, nylon-6,10, copolymer nylons, alkoxymethylated nylons and the like), polyurethane, gelatin and aluminum oxide.

The thickness of the intermediate layer is in the range of 0.1 to 20 μm, preferably 0.5 to 5 μm.

An electrophotographic photoreceptor equipped with a photoreceptor containing the enamine derivative of the present invention as a carrier transport material has a high sensitivity and a high durability. In contrast to conventional inorganic electrophotographic photoreceptors, the electrophotographic photoreceptor of the present invention has advantages of an organic photoreceptor. That is to say, the electrophotographic photoreceptor of the present invention is nontoxic, light-weight, easy to form films, easy to manufacture the photoreceptor and excellent in stability to temperature and humidity, and has no problem regarding resources, a good transparency, positive and negative charging properties and high charging properties. In addition, the light sensitivity of the electrophotographic photoreceptor scarcely deteriorates, even when it is used repeatedly.

Now, the present invention will be described in more detail with reference to examples, but the scope of the present invention should not be limited to these examples at all.

EXAMPLE 1

Synthesis Example (Exemplary Compound No. 1)

p-methoxyaniline and 2 equivalents of 1-formyl-1,2,3,4-tetrahydronaphthalene were heated in benzene by the use of p-toluenesulfonic acid as a catalyst to dehydrate and condense them, and the resultant condensate was then recrystallized from ethanol-ethyl acetate to obtain a compound having a melting point of 164° to 166° C.

It was confirmed from $^{13}$C-NMR spectra that the thus obtained compound was Exemplary Compound No. 1.

Figure 7:
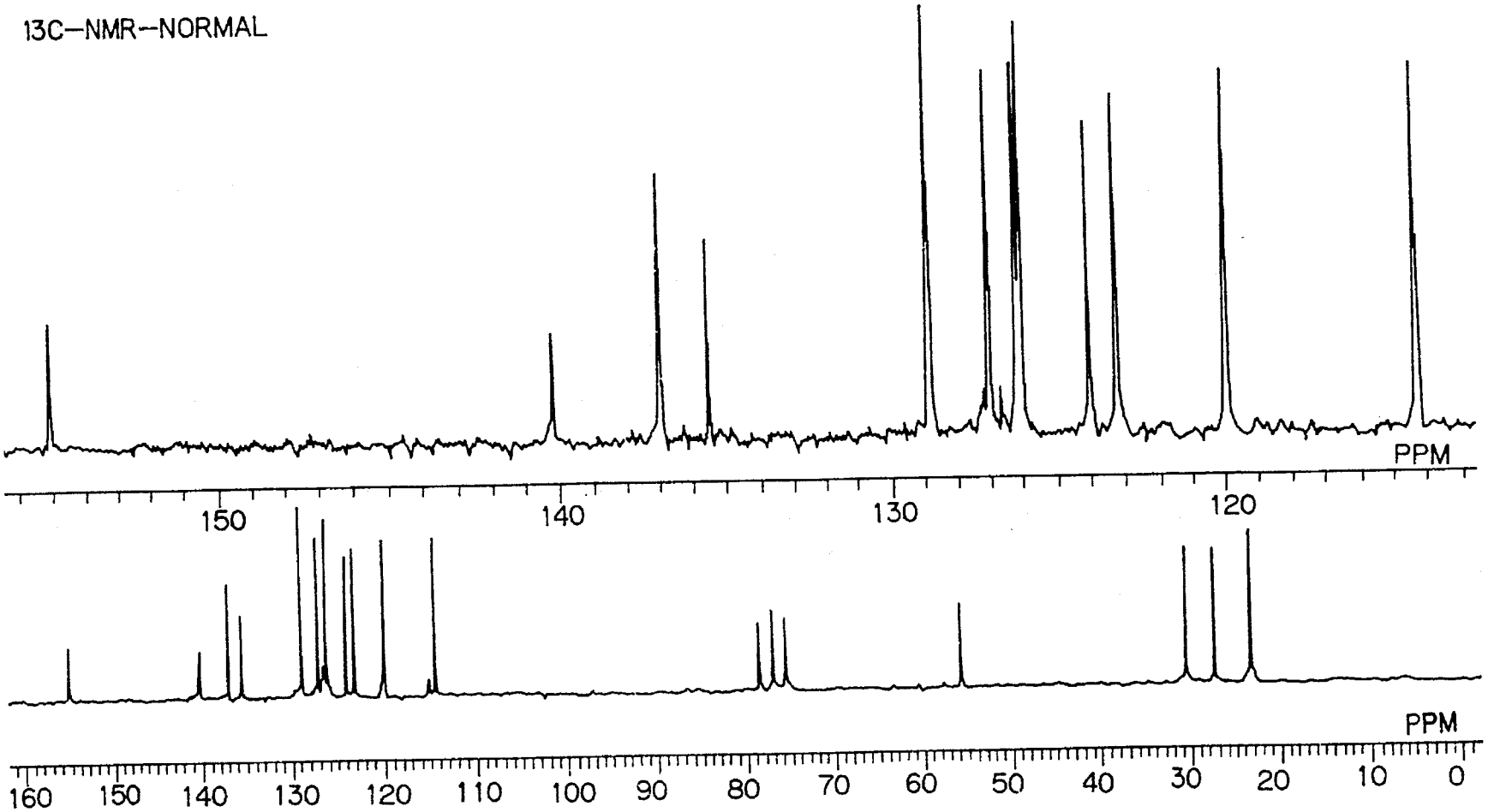
FIG. 7 is a usual $^{13}$C-NMR spectrum of Exemplary compound No. 1 of the present invention.
Figure 8:
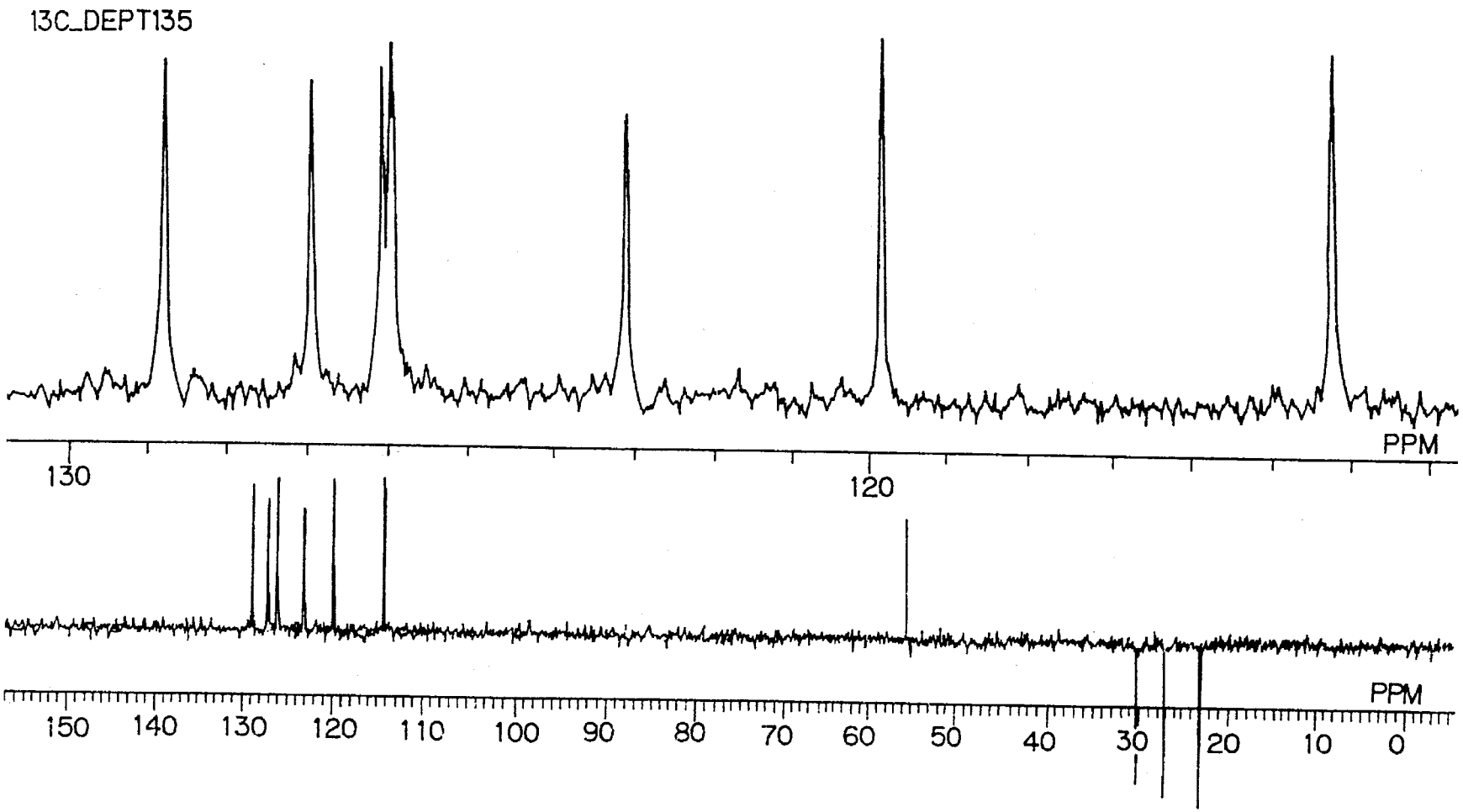
FIG. 8 is a $^{13}$C-NMR spectrum by DEPT-135 of Exemplary Compound No. 1 of the present invention.

FIG. 7 is a usual $^{13}$C-NMR spectrum, and FIG. 8 is a $^{13}$C-NMR spectrum by DEPT-135.

In the two spectra shown in FIGS. 7 and 8, a peak of a methoxy group and three peaks of methylene groups were observed at 55.61 ppm and at 23.03, 27.15 and 30.31 ppm, respectively, by which Exemplary Compound No. 1 was characterized.

A bis-azo pigment represented by the formula

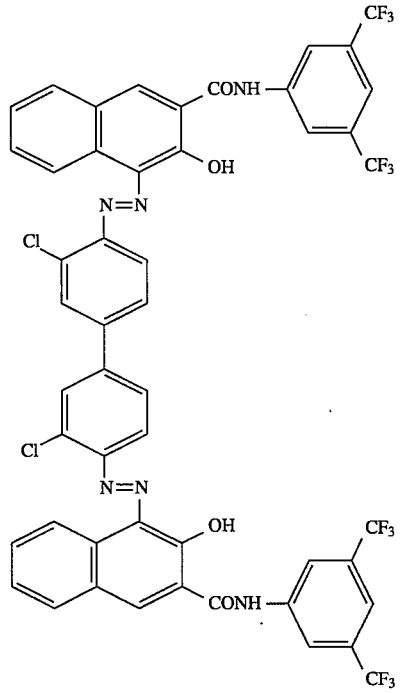

was added to a 1% tetrahydrofuran (THF) solution containing a dissolved phenoxy resin (trade name PKHH, made by Union Carbide Corp.), the amount of the pigment being equal to that of the resin in terms of weight. The resultant mixture and glass beads having a diameter of 1.5 mm were then dispersed in a paint conditioner (made by Red Devil Co., Ltd.) for about 2 hours. Next, the thus obtained dispersion was applied onto an aluminum-deposited polyester film (thickness=80 μm) as a support by a doctor blade method, followed by drying. The dried film had a thickness of 0.2 μm.

Afterward, 1 g of Exemplary Compound No. 1 of the present invention and 1.2 g of polyarylate (trade name U-100, made by Unitika Ltd.) were dissolved in methylene chloride to form a 15% solution, and this solution was then applied onto the already formed pigment layer (a carrier generation layer) by a squeegeeing doctor to form a resin-enamine derivative solid solution phase (a carrier transport layer) having a dried film thickness of 25 μm, thereby obtaining a laminated electrophotographic photoreceptor.

For this laminated electrophotographic photoreceptor, electrophotographic properties were evaluated by means of an electrostatic recording paper test device (trade name SP-428, made by Kawaguchi Denki Co., Ltd.).

Under measurement conditions of an applied voltage of −6 KV and a static of No. 3, there were measured an exposure $E_{100}$ (lux.second) required to attenuate from −700 V to −100 V by the irradiation of white light (irradiated light=5 lux) and an initial voltage $V_0$ (−voltage), and the measured values are shown in Table 25. Furthermore, after an operation of electrification and non-electrification (non-electrification light: irradiation with the white light at 40 lux for 1 second) was repeated 10,000 times by the use of the same device, the initial voltage $V_0$ (−voltage) and the $E_{100}$ (lux.second) were measured to inspect changes of the $V_0$ and the $E_{100}$ (sensitivity repeating properties). The results are shown in Table 25.

EXAMPLES 2 to 7

Synthesis Example 2 (Exemplary Compound No. 3)

p-methylaniline and 2 equivalents of 1-formyl- 1,2,3,4-tetrahydronaphthalene were heated in benzene by the use of p-toluenesulfonic acid as a catalyst to dehydrate and condense them, and the resultant condensate was then recrystallized from ethanol-ethyl acetate to obtain a compound having a melting point of 125° to 126° C.

It was confirmed from $^{13}$C-NMR spectra that the thus obtained compound was Exemplary Compound No. 3.

Figure 9:
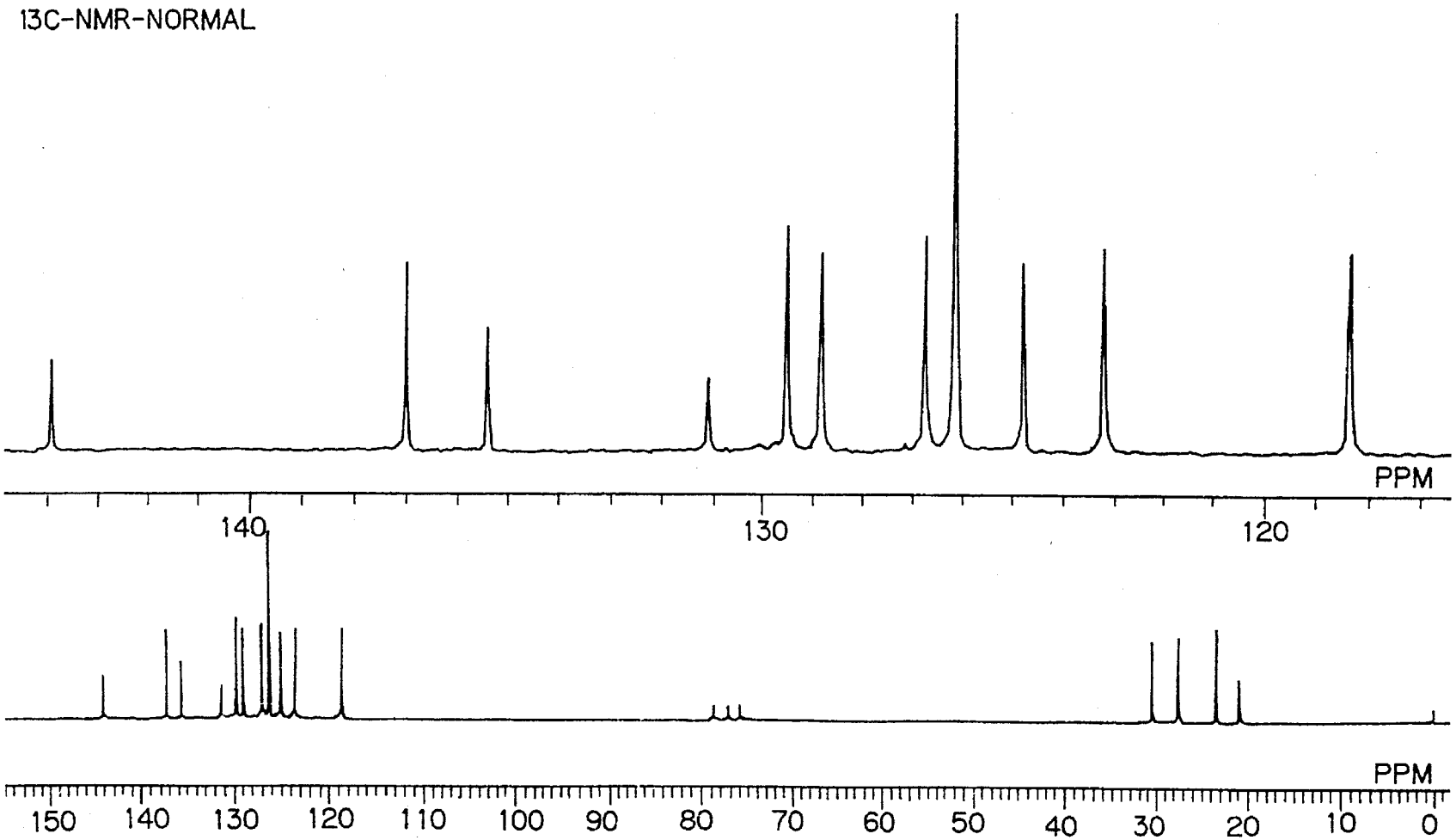
FIG. 9 is a usual $^{13}$C-NMR spectrum of Exemplary Compound No. 3 of the present invention.
Figure 10:
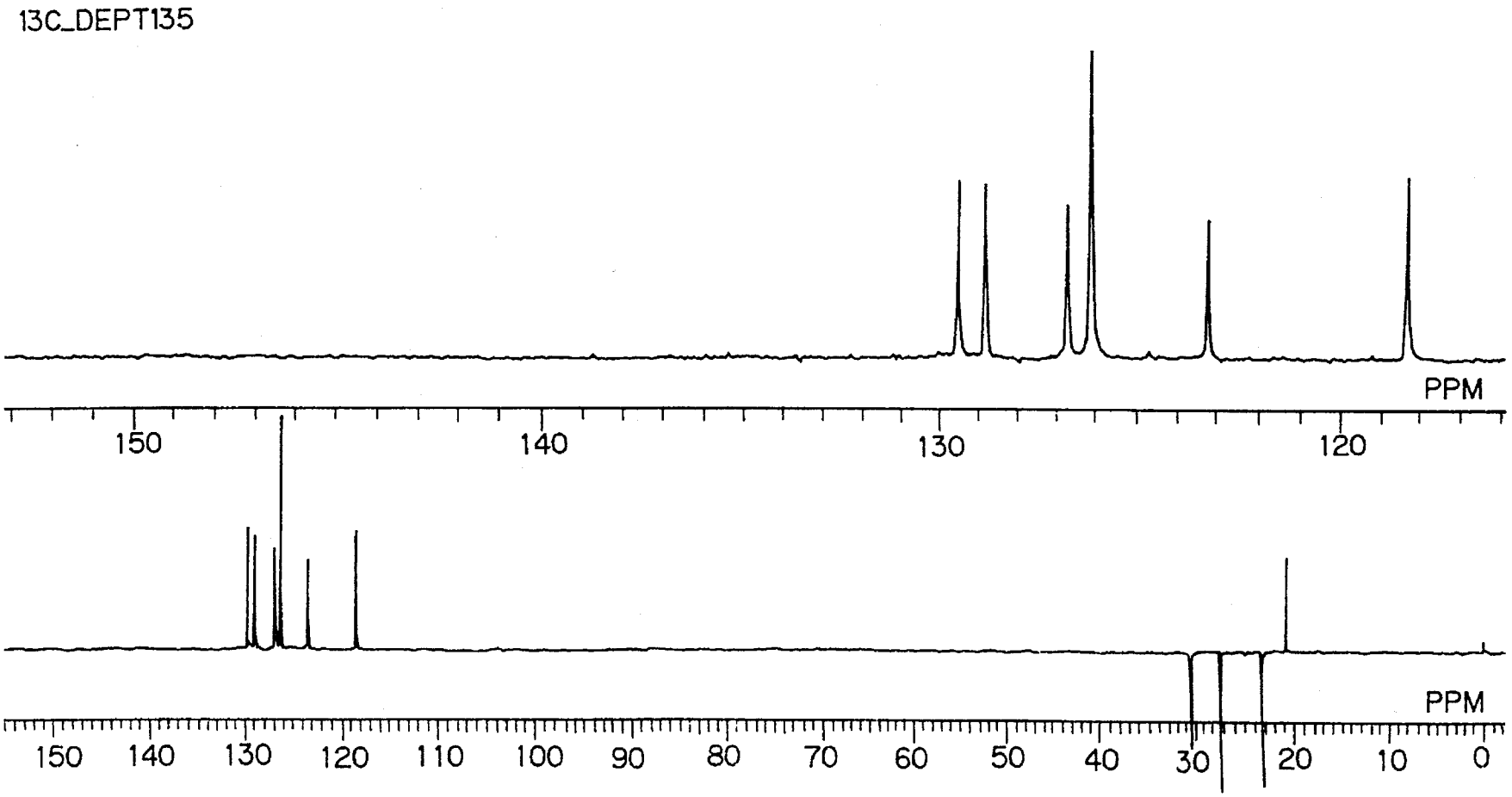
FIG. 10 is a $^{13}$C-NMR spectrum by DEPT-135 of Exemplary Compound No. 3 of the present invention.

FIG. 9 is a usual $^{13}$C-NMR spectrum, and FIG. 10 is a $^{13}$C-NMR spectrum by DEPT-135.

In the two spectra shown in FIGS. 9 and 10, a peak of a methyl group and three peaks of methylene groups were observed at 20.55 ppm and at 23.00, 27.18 and 30.31 ppm, respectively, by which Exemplary Compound No. 3 was characterized.

Synthesis Example 3 (Exemplary Compound No. 16)

p-methoxyaniline and 2 equivalents of 1-formyl-1,2,3,4-tetrahydronaphthalene were heated in benzene by the use of p-toluenesulfonic acid as a catalyst to dehydrate and condense them, and the resultant condensate was then recrystallized from ethanol-ethyl acetate to obtain a compound having a melting point of 172° to 173° C.

It was confirmed from $^{13}$C-NMR spectra that the thus obtained compound was Exemplary Compound No. 16.

Figure 11:
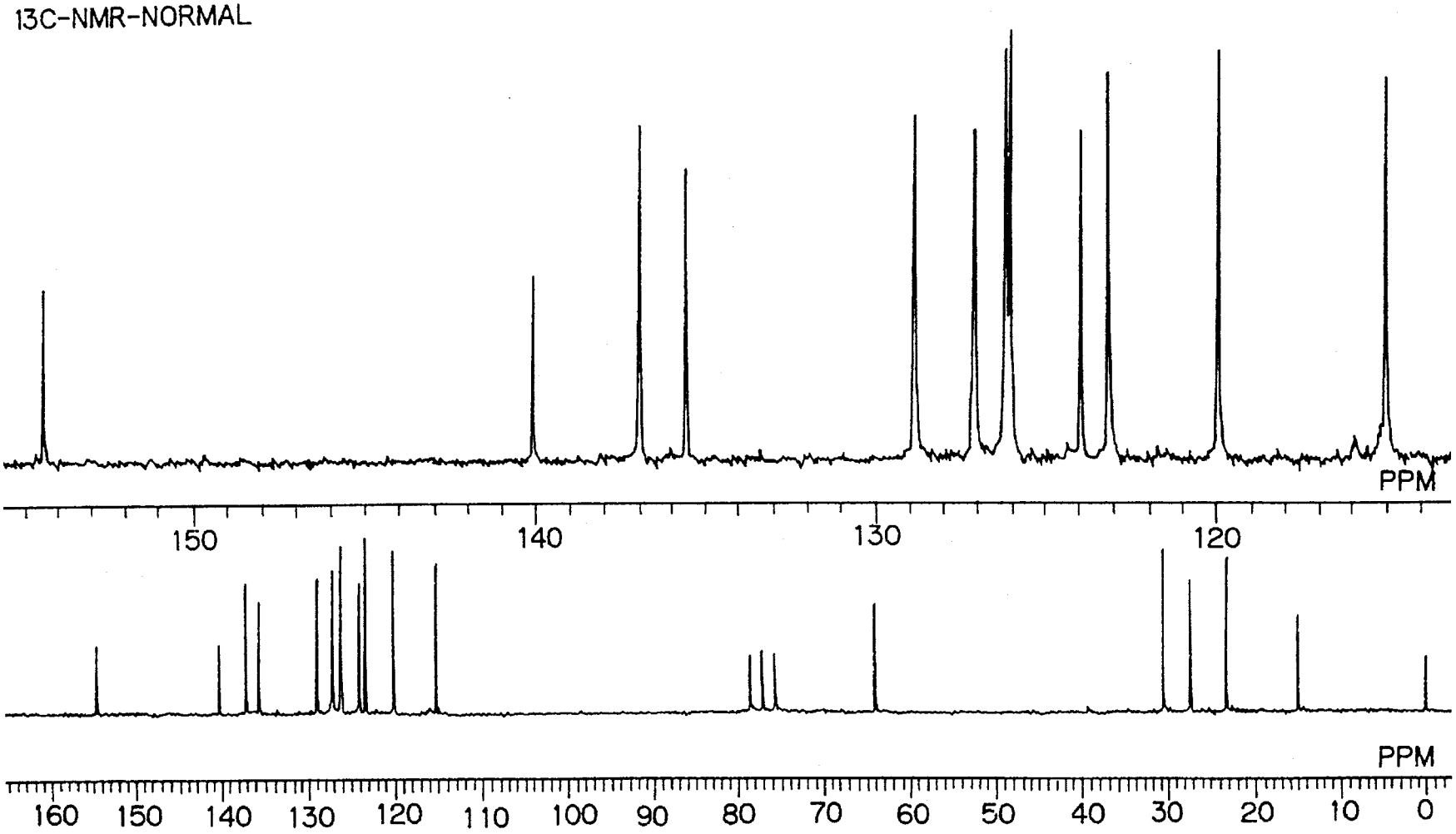
FIG. 11 is a usual $^{13}$C-NMR spectrum of Exemplary Compound No. 16 of the present invention.
Figure 12:
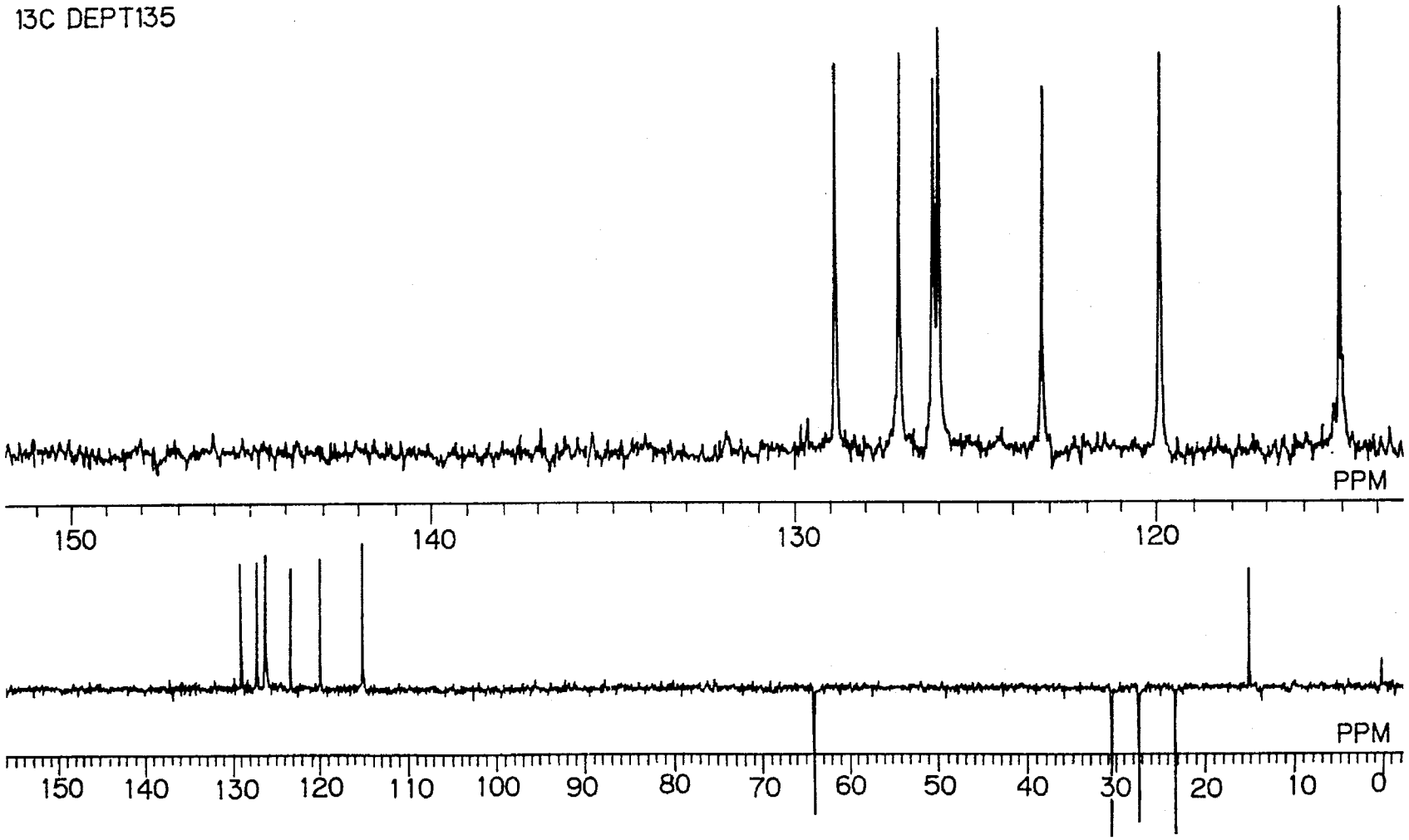
FIG. 12 is a $^{13}$C-NMR spectrum by DEPT-135 of Exemplary Compound No. 16 of the present invention.

FIG. 11 is a usual $^{13}$C-NMR spectrum, and FIG. 12 is a $^{13}$C-NMR spectrum by DEPT-135.

In the two spectra shown in FIGS. 11 and 12, a peak of a methyl group of an ethoxy group, a peak of a methylene group of the ethoxy group and three peaks of methylene groups were observed at 14.91 ppm, at 63.84 ppm and at 23.03, 27.15 and 30.34 ppm, respectively, by which Exemplary Compound No. 16 was characterized.

Synthesis Example 4 (Exemplary Compound No. 26)

3,4-(methylenedioxy)aniline and 2 equivalents of 1-formyl-1,2,3,4-tetrahydronaphthalene were heated in benzene by the use of p-toluenesulfonic acid as a catalyst to dehydrate and condense them, and the resultant condensate was then recrystallized from ethanol-ethyl acetate to obtain a compound having a melting point of 155° to 156° C., It was confirmed from $^{13}$C-NMR spectra that the thus obtained compound was Exemplary Compound No. 26.

Figure 13:
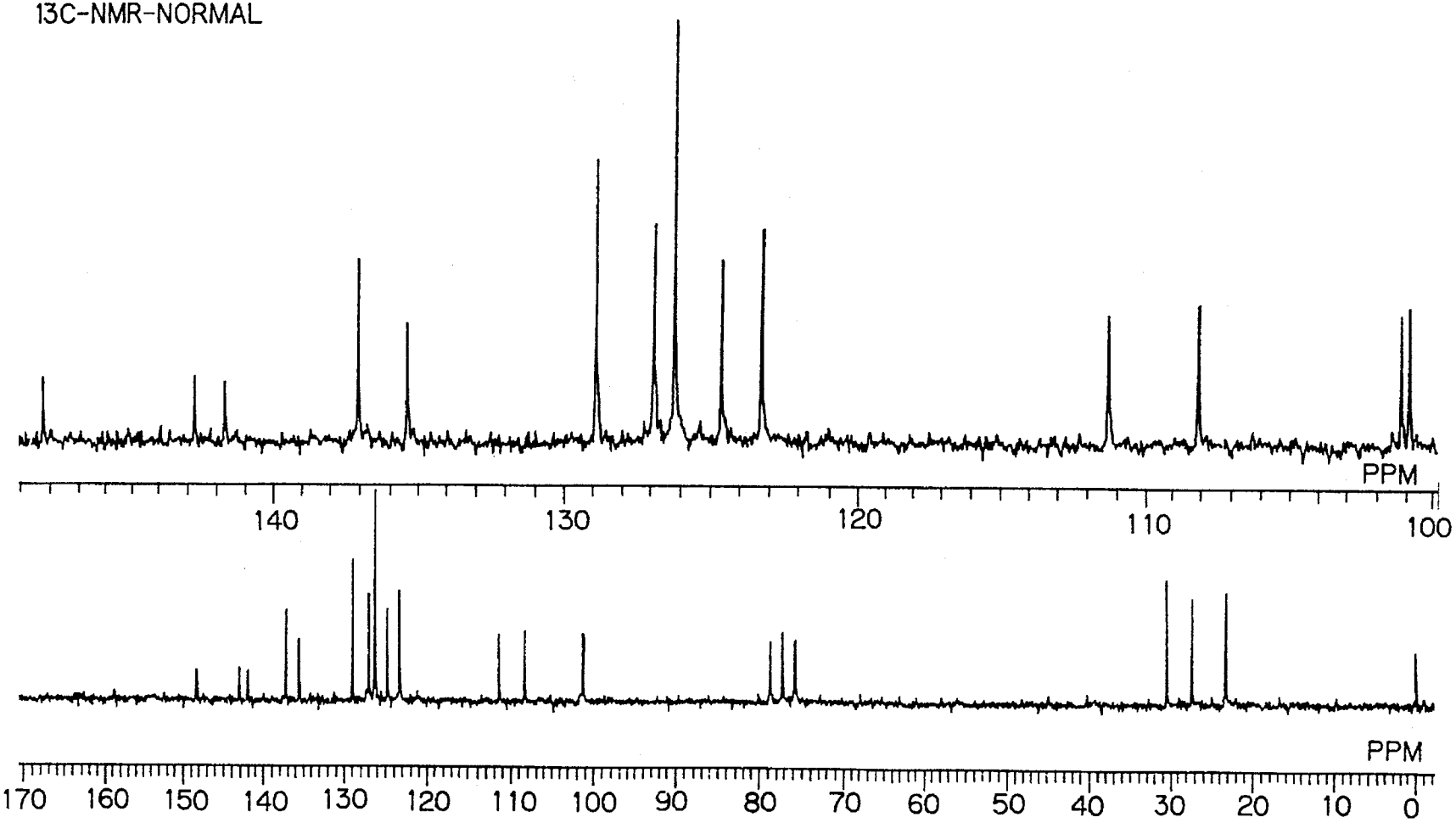
FIG. 13 is a usual $^{13}$C-NMR spectrum of Exemplary Compound No. 26 of the present invention.
Figure 14:
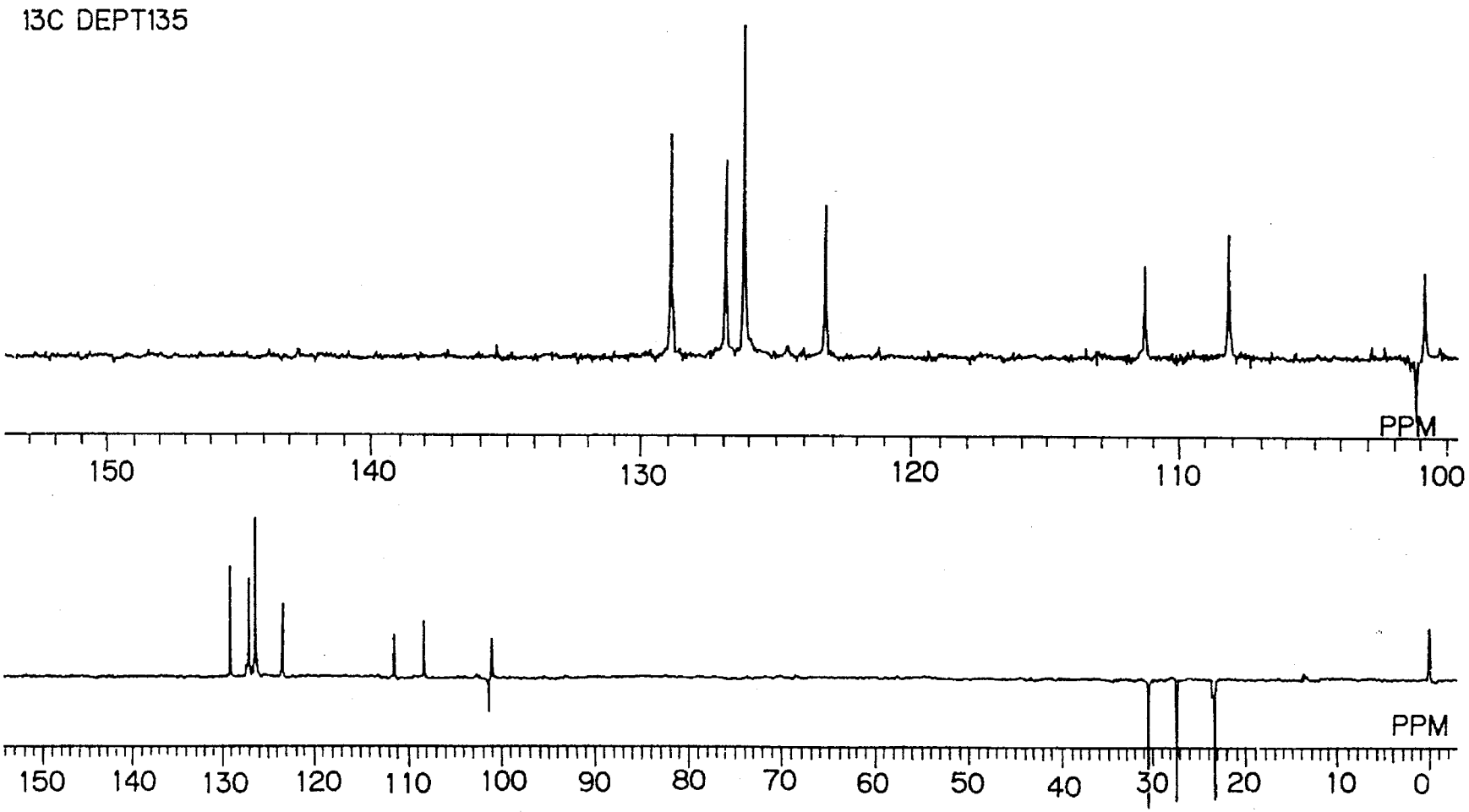
FIG. 14 is a $^{13}$C-NMR spectrum by DEPT-135 of Exemplary Compound No. 26 of the present invention.

FIG. 13 is a usual $^{13}$C-NMR spectrum, and FIG. 14 is a $^{13}$C-NMR spectrum by DEPT-135.

In the two spectra shown in FIGS. 13 and 14, a peak of a dioxymethylene group and three peaks of methylene groups were observed at 101.11 ppm and at 23.03, 27.15 and 30.31 ppm, respectively, by which Exemplary Compound No. 26 was characterized.

The same procedure as in Example 1 was carried out except that Exemplary Compound Nos. 3, 16, 26, 28, 58 and 86 were used. The results are shown in Table 25.

TABLE 25

| Electro-photo-graphic Photo-receptor | Examplary Compound No. | Repeating Properties 1st Time $V_0$ (V) | 1st Time $E_{100}$ (lux · sec) | 10000th Time $V_0$ (V) | 10000th Time $E_{100}$ (lux · sec) |
|---|---|---|---|---|---|
| Example 1 | No. 1 | 830 | 2.1 | 820 | 2.2 |
| Example 2 | No. 3 | 815 | 1.8 | 800 | 1.8 |
| Example 3 | No. 16 | 810 | 1.9 | 805 | 2.0 |
| Example 4 | No. 26 | 825 | 1.7 | 820 | 1.7 |
| Example 5 | No. 28 | 840 | 1.7 | 820 | 1.7 |
| Example 6 | No. 58 | 800 | 2.0 | 790 | 1.9 |
| Example 7 | No. 86 | 820 | 1.8 | 810 | 1.8 |

It is apparent from Table 25 that the enamine derivatives of the present invention are also excellent in sensitivity repeating properties.

EXAMPLE 8

0.4 g of X type metal-free phthalocyanine (trade name Firstgen Blue 8120, made by Dainippon Ink & Chemicals, Inc.) was added to 30 ml of an ethyl acetate solution in which 0.3 g of a vinyl chloride-vinyl acetate copolymer resin (trade name Eslex M, made by Sekisui Chemical Co., Ltd.) was dissolved, and the mixture was then dispersed in a paint conditioner for about 20 minutes. Next, the thus obtained dispersion was applied onto an aluminum-deposited polyester film by a doctor blade method to form a carrier generation layer so that the thickness of the dried layer might be 0.4 μm.

A polyarylate layer containing 50% by weight of the enamine derivative Exemplary Compound No. 4 was laminated on this carrier generation layer to form a photoreceptor comprising a double-layered structure. For the photoreceptor, an energy ($E_{50}$) required to reduce its potential by half and an initial potential ($-V_0$) were measured by the use of a spectrum at 780 nm. As a result, the $V_0$ was 880 V and the $E_{50}$ was 2.9 erg/cm$^2$, and it was apparent that the photoreceptor had a very high sensitivity and high charging properties.

Furthermore, a laser printer (WD-580P) made by Sharp Corporation was remodeled, and the above-mentioned photoreceptor was attached to a drum portion of the printer. Afterward, non-copy aging was continuously carried out 10,000 times to inspect the deterioration of the initial potential and the sensitivity.

As a result, the $V_0$ was 870 V and the $E_{50}$ was 2.9 erg/cm$^2$, and these values scarcely deteriorated, as compared with those of the first test.

EXAMPLES 9 to 12

In methylene chloride were dissolved 1 g of each of Exemplary Compound Nos. 11, 46, 91 and 93, 1.1 g of polyarylate represented by the following formula, 0.15 g of N,N-3,5-xylyl-3,4-xylyl-3,4,9,10-perylenetetracarboxylimide and 0.05 g of an ultraviolet light absorber (the imide compound was partially in a dispersion state), and the resultant solution was then applied, by an applicator, onto a support obtained by subjecting the surface of an aluminum substrate to an Alumite treatment (an Alumite layer=7 μm) to obtain a single-layered photoreceptor having a dried film thickness of 20 μm:

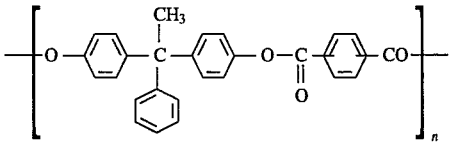

For the thus obtained photoreceptor, electrophotographic properties were measured by an electrostatic recording paper test device. As measurement conditions, applied voltage was +5.5 KV and a static was No. 3. An exposure $E_{100}$ (lux.second) required to attenuate from +700 V to +100 V by irradiation with white light was measured, and the measured values are shown in Table 26. Moreover, a noncopy aging test was carried out 10,000 times to inspect the deterioration of the sensitivity $E_{100}$, and the results are shown in Table 26.

TABLE 26

| Electrophotographic Photorerecptor | Exemplary Compound | $E_{100}$ (lux · sec) 1st Time | 10000th Time |
|---|---|---|---|
| Example 9 | No. 11 | 2.4 | 2.5 |
| Example 10 | No. 46 | 2.2 | 2.2 |
| Example 11 | No. 91 | 2.3 | 2.4 |
| Example 12 | No. 93 | 2.1 | 2.1 |

It is apparent that the photoreceptors using the enamine derivatives of the present invention are excellent in sensitivity and repeating properties even in the case of the positive charging.

EXAMPLES 13 to 17

By the use of Exemplary Compound Nos, 1, 3, 28, 58 and 86, laminated electrophotographic photoreceptors were prepared under the same conditions as in Examples 1, 2, 5, 6 and 7, and electrophotographic properties were then evaluated under circumstances of a temperature of 35° C. and a humidity of 85% by means of an electrostatic recording paper test device (trade name SP-428, made by Kawaguchi Denki Co., Ltd.).

Under measurement conditions of an applied voltage of −6 KV and a static of No. 3, an initial voltage $V_0$ (−voltage) was measured, and the measured values are shown in Table 27. Furthermore, after an operation of electrification and non-electrification (non-electrification light: irradiation with the white light at 40 lux for 1 second) was repeated 10,000 times by the use of the same device, the initial voltage $V_0$ (−voltage) was measured to inspect a change of the $V_0$. The results are shown in Table 27.

TABLE 27

| Electrophotographic Photorerecptor | Exemplary Compound | Repeating Properties 1st Time $V_0$ (V) | 10000th Time $V_0$ (V) |
|---|---|---|---|
| Example 13 | No. 1 | 840 | 810 |
| Example 14 | No. 3 | 820 | 800 |
| Example 15 | No. 28 | 850 | 825 |
| Example 16 | No. 58 | 815 | 795 |
| Example 17 | No. 86 | 830 | 805 |

It is apparent from Table 27 that the enamine derivatives of the present invention are excellent in stability to temperature and humidity.

EXAMPLE 18

Synthesis Example (Exemplary Compound No. 130)

p-nitrobenzaldehyde and N,N-diphenylhydrazine hydrochloride were heated in the presence of potassium acetate as a catalyst in ethanol to obtain p-nitrobenzaldehyde-N,N-diphenylhydrazone.

Next, the thus obtained compound was subjected to a reduction reaction with an iron powder in a mixed solvent of 1,4-dioxane and water to obtain p-aminobenzaldehyde-N,N-diphenylhydrazone.

Afterward, this compound was dehydrated and condensed with 2 equivalents of 1-formyl-1,2,3,4-tetrahydronaphthalene in toluene to obtain the desired Exemplary Compound No. 130 (melting point=154°–156° C.). In this case, recrystallization was carried out from ethanol-ethyl acetate.

It was confirmed from $^{13}$C-NMR spectra that the thus obtained compound was Exemplary Compound No. 130.

Figure 15:
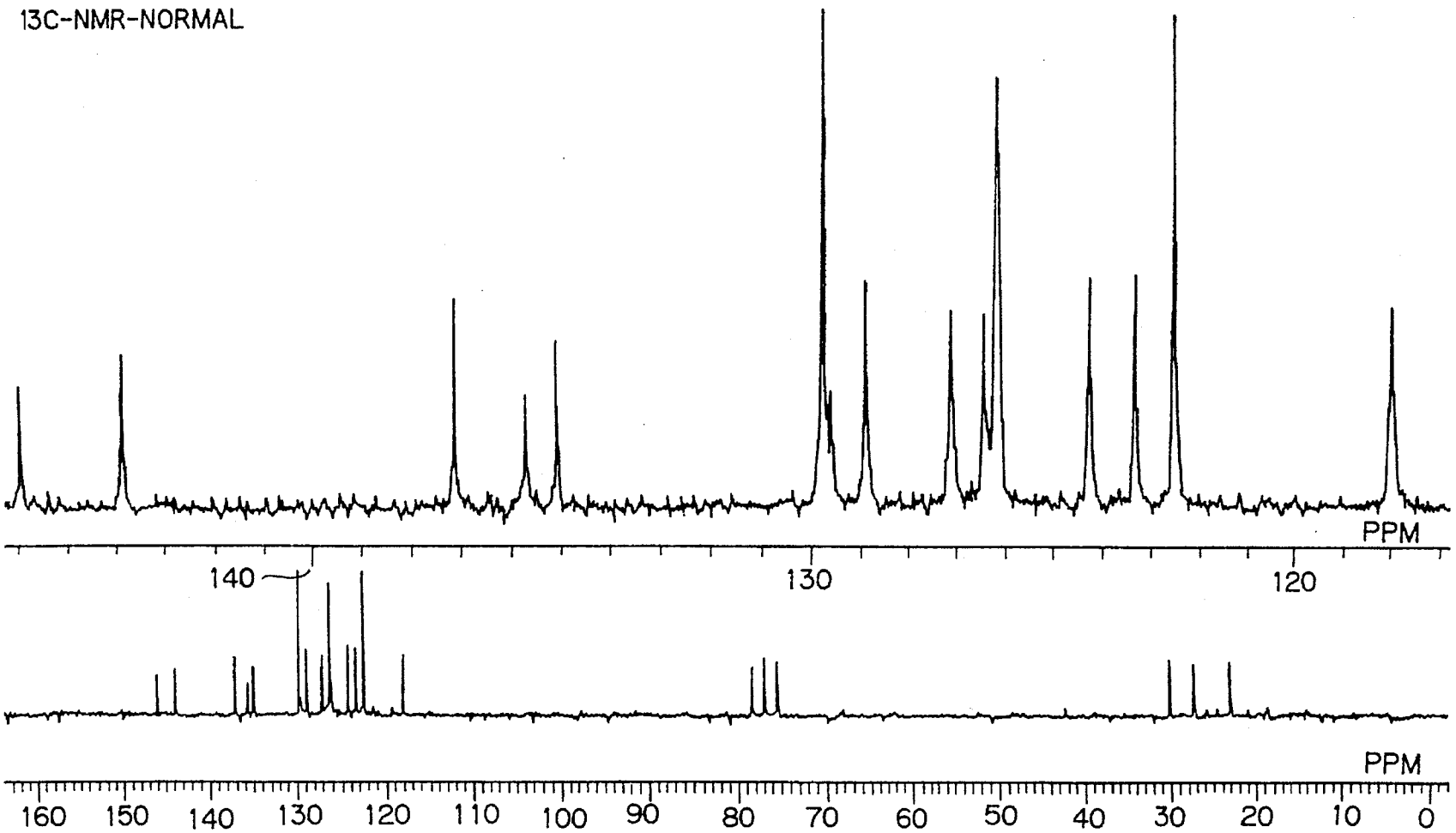
FIG. 15 is a usual $^{13}$C-NMR spectrum of Exemplary Compound No. 130 of the present invention.
Figure 16:
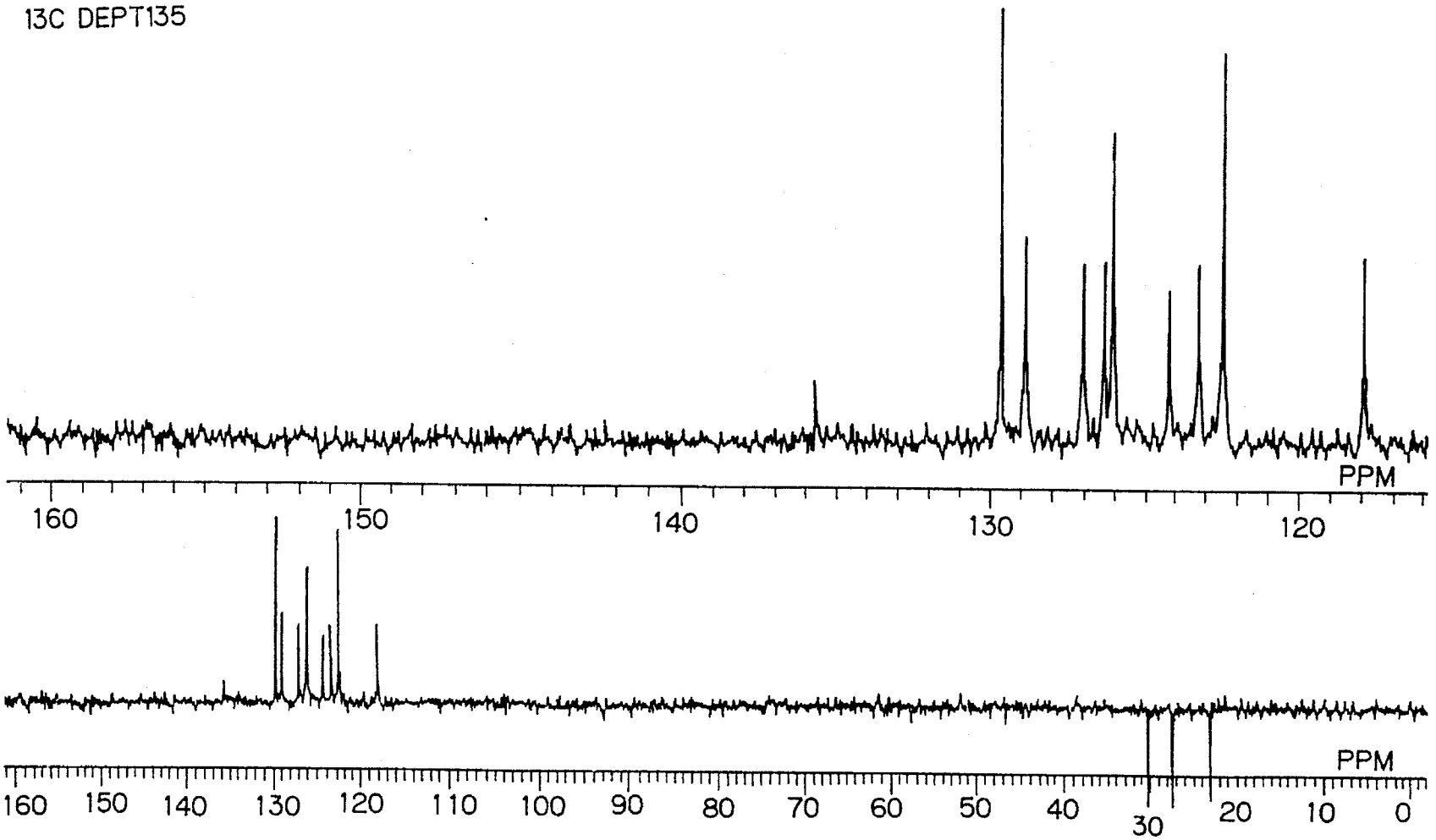
FIG. 16 is a $^{13}$C-NMR spectrum by DEPT-135 of Exemplary Compound No. 130 of the present invention.

FIG. 15 is a usual $^{13}$C-NMR spectrum, and FIG. 16 is a $^{13}$C-NMR spectrum by DEPT-135.

In the two spectra, three peaks of methylene groups were observed at 22.97, 27.21 and 30.29 ppm, respectively, by which Exemplary Compound No. 130 was characterized.

A bis-azo pigment represented by the formula

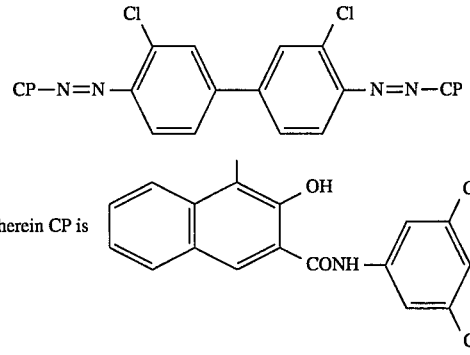

was added to a 1% THF solution of a phenoxy resin (trade name PKHH, made by Union Carbide Corp.), the amount of the pigment being equal to that of the resin in terms of weight. The resultant mixture and glass beads having a diameter of 1.5 mm were then dispersed in a paint conditioner (made by Red Devil Co., Ltd.) for about 2 hours. Next, the thus obtained dispersion was applied onto an aluminum-deposited polyester film (thickness=80 μm) as a condutive support by a doctor blade method, followed by drying to form a pigment layer (a carrier generation layer). The dried film had a thickness of 0.2 μm.

Afterward, 1 g of Exemplary Compound No. 130 and 1.2 g of a polyarylate resin (trade name U-100, made by Unitika Ltd.) were dissolved in methylene chloride to form a 15% solution, and this solution was then applied onto the already formed pigment layer (the carrier generation layer) by a squeegeeing doctor to form an enamine derivative solid solution phase (a carrier transport layer) having a dried film thickness of 25 μm, thereby obtaining a laminated electrophotographic photoreceptor.

For this laminated electrophotographic photoreceptor, electrophotographic properties were evaluated by means of an electrostatic recording paper test device (trade name SP-428, made by Kawaguchi Denki Co., Ltd.).

Under measurement conditions of an applied voltage of −6 kV and a static of No. 3, there were measured an exposure $E_{100}$ (lux.second) required to attenuate from −700 V to −100 V by the irradiation of white light (irradiated light=5 lux) and an initial voltage $V_0$ (−voltage), and the measured values are shown in Table 28. Furthermore, after an operation of electrification and non-electrification (non-electrification light: irradiation with the white light at 40 lux for 1 second) was repeated 10,000 times by the use of the same device, the initial voltage $V_0$ (−voltage) and the $E_{100}$ (lux.second) were measured to inspect changes of the $V_0$ and the $E_{100}$. The results are shown in Table 28.

EXAMPLES 19 to 22

Electrophotographic photoreceptors were prepared under the same conditions as in Example 18 except that Exemplary Compound Nos, 111 (Example 19), 195 (Example 20), 200 (Example 21) and 147 (Example 22) were used in place of Exemplary Compound No. 130, and characteristics were then measured. The measured results are shown in Table 28.

TABLE 28

| Electro-photo-graphic Photo-receptor | Examplary Compound No. | Repeating Properties 1st Time $E_{100}$ (lux · sec) | 1st Time $V_0$ (V) | 10000th Time $E_{100}$ (lux · sec) | 10000th Time $V_0$ (V) |
|---|---|---|---|---|---|
| Example 18 | No. 130 | 1.6 | 830 | 1.7 | 825 |
| Example 19 | No. 111 | 1.9 | 805 | 2.1 | 800 |
| Example 20 | No. 195 | 2.1 | 835 | 2.2 | 820 |
| Example 21 | No. 200 | 1.8 | 860 | 1.9 | 845 |
| Example 22 | No. 147 | 2.4 | 840 | 2.6 | 830 |

It is apparent from Table 28 that these enamine derivatives all permit the preparation of the electrophotographic photoreceptors which are excellent in sensitivity repeating properties.

EXAMPLE 23

0.4 g of X type metal-free phthalocyanine (trade name Firstgen Blue 8120, made by Dainippon Ink & Chemicals, Inc.) was added to 30 ml of an ethyl acetate solution in which 0.3 g of a vinyl chloride-vinyl acetate copolymer resin (trade name Eslex M, made by Sekisui Chemical Co., Ltd.) was dissolved, and the mixture was then dispersed in a paint conditioner for about 20 minutes. Next, the thus obtained dispersion was applied onto an aluminum-deposited polyester film by a doctor blade method to form a carrier generation layer so that the thickness of the dried layer might be 0.4 μm.

A polyarylate layer (a carrier transport layer) containing 50% by weight of the enamine derivative Exemplary Compound No. 127 was laminated on this carrier generation layer to form a photoreceptor comprising a double-layered structure.

For the thus formed photoreceptor, an energy ($E_{50}$) required to reduce its potential by half and an initial potential ($-V_0$) were measured by the use of a spectrum at 780 nm. As a result, the $V_0$ was 880 V and the $E_{50}$ was 2.1 erg/cm$^2$, and it was apparent that the photoreceptor had a very high sensitivity and high charging properties. Furthermore, a laser printer (WD-580P) made by Sharp Corporation was remodeled, and the above-mentioned photoreceptor was attached to a drum portion of the printer. Afterward, non-copy aging was continuously carried out 10,000 times to inspect the deterioration of the initial potential and the sensitivity.

As a result, the $V_0$ was 875 V and the $E_{50}$ was 2.1 erg/cm$^2$, and these values scarcely deteriorated, as compared with those of the first test, and it was apparent that repeating properties were good.

EXAMPLE 24

In methylene chloride were dissolved 1 g of an enamine derivative Exemplary Compound No. 117, 1.1 g of a polyarylate resin represented by the following formula, 0.15 g of N,N-3,5-xylyl-3,4-xylyl-3,4,9,10-perylenetetracarboxylimide and 0.05 g of an ultraviolet light absorber (the imide compound was partially in a dispersion state), and the resultant solution was then applied, by an applicator, onto a conductive support obtained by subjecting the surface of an aluminum substrate to an Alumite treatment (an Alumite layer=7 μm) to obtain a single-layered photoreceptor having a dried film thickness of 20 μm:

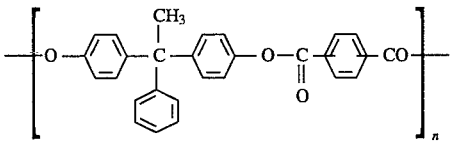

For the thus obtained photoreceptor, electrophotographic properties were measured by an electrostatic recording paper test device under measurement conditions of an applied voltage of +5.5 KV and a static of No. 3. An exposure $E_{100}$ (lux.second) required to attenuate from +700 V to +100 V by irradiation with white light was measured, and the measured values are shown in Table 29. Moreover, a non-copy aging test was made 10,000 times to inspect the deterioration of the sensitivity $E_{100}$, and the results are also shown in Table 29.

EXAMPLES 25 to 27

Electrophotographic photoreceptors were prepared under the same conditions as in Example 24 except that Exemplary Compound Nos, 140 (Example 25), 177 (Example 26) and 187 (Example 27) were used in place of Exemplary Compound No. 117, and characteristics were then measured. The measured results are shown in Table 29.

TABLE 29

| Electrophotographic Photorerecptor | Exemplary Compound | Repeating Properties $E_{100}$ (lux · sec) 1st Time | 10000th Time |
|---|---|---|---|
| Example 24 | No. 117 | 1.9 | 2.1 |
| Example 25 | No. 140 | 2.2 | 2.3 |
| Example 26 | No. 177 | 1.9 | 2.2 |
| Example 27 | No. 187 | 1.8 | 1.9 |

It is apparent that the electrophotographic photoreceptors using the above-mentioned enamine derivatives are excellent in sensitivity and have good repeating properties even in the case of the positive charging.

EXAMPLES 28 to 32

By the use of Exemplary Compound Nos, 130, 111, 195, 200 and 147, laminated electrophotographic photoreceptors were prepared under the same conditions as in Examples 18 to 22, and electrophotographic properties were then evaluated under circumstances of a temperature of 35° C. and a humidity of 85% by means of an electrostatic recording paper test device (trade name SP-428, made by Kawaguchi Denki Co., Ltd.).

Under measurement conditions of an applied voltage of −6 kV and a static of No. 3, an initial voltage $V_0$ (−voltage) was measured, and the measured values are shown in Table 30.

Furthermore, after an operation of electrification and non-electrification (non-electrification light: irradiation with the white light at 40 lux for 1 second) was repeated 10,000 times by the use of the same device, the initial voltage $V_0$ (−voltage) was measured to inspect a change of the $V_0$.

TABLE 30

| Electrophotographic Photorerecptor | Exemplary Compound | Repeating Properties 1st Time $V_0$ (V) | 10000th Time $V_0$ (V) |
|---|---|---|---|
| Example 28 | No. 130 | 840 | 820 |
| Example 29 | No. 111 | 810 | 790 |
| Example 30 | No. 195 | 840 | 815 |
| Example 31 | No. 200 | 870 | 845 |
| Example 32 | No. 147 | 850 | 810 |

It is apparent from Table 30 that the enamine derivatives of the present invention are also excellent in stability to temperature and humidity.

EXAMPLES 33 to 37

Synthesis Example (Exemplary Compound No. 261)

p-(dimethylamino)benzaldehyde was reacted with diethyl p-nitrobenzylsulfonate in the presence of potassium t-butoxide in tetrahydrofuran to obtain 4-(dimethylamino)-4'-nitrostilbene. Next, the thus obtained compound was subjected to a reduction reaction with an iron powder in the presence of hydrochloric acid as a catalyst in a mixed solvent of 1,4-dioxane and water to obtain 4-(dimethylamino)-4'-aminostilbene. Afterward, this compound was dehydrated and condensed with 2 equivalents of 1-formyl-1,2,3,4-tetrahydronaphthalene in toluene to obtain Exemplary Compound No. 261 (melting point=201°–203° C.).

It was confirmed from $^{13}$C-NMR spectra that the thus obtained compound was Exemplary Compound No. 261. That is to say, FIG. 17 is a usual $^{13}$C-NMR spectrum, and FIG. 18 is a $^{13}$C-NMR spectrum by DEPT-135.

Figure 17:
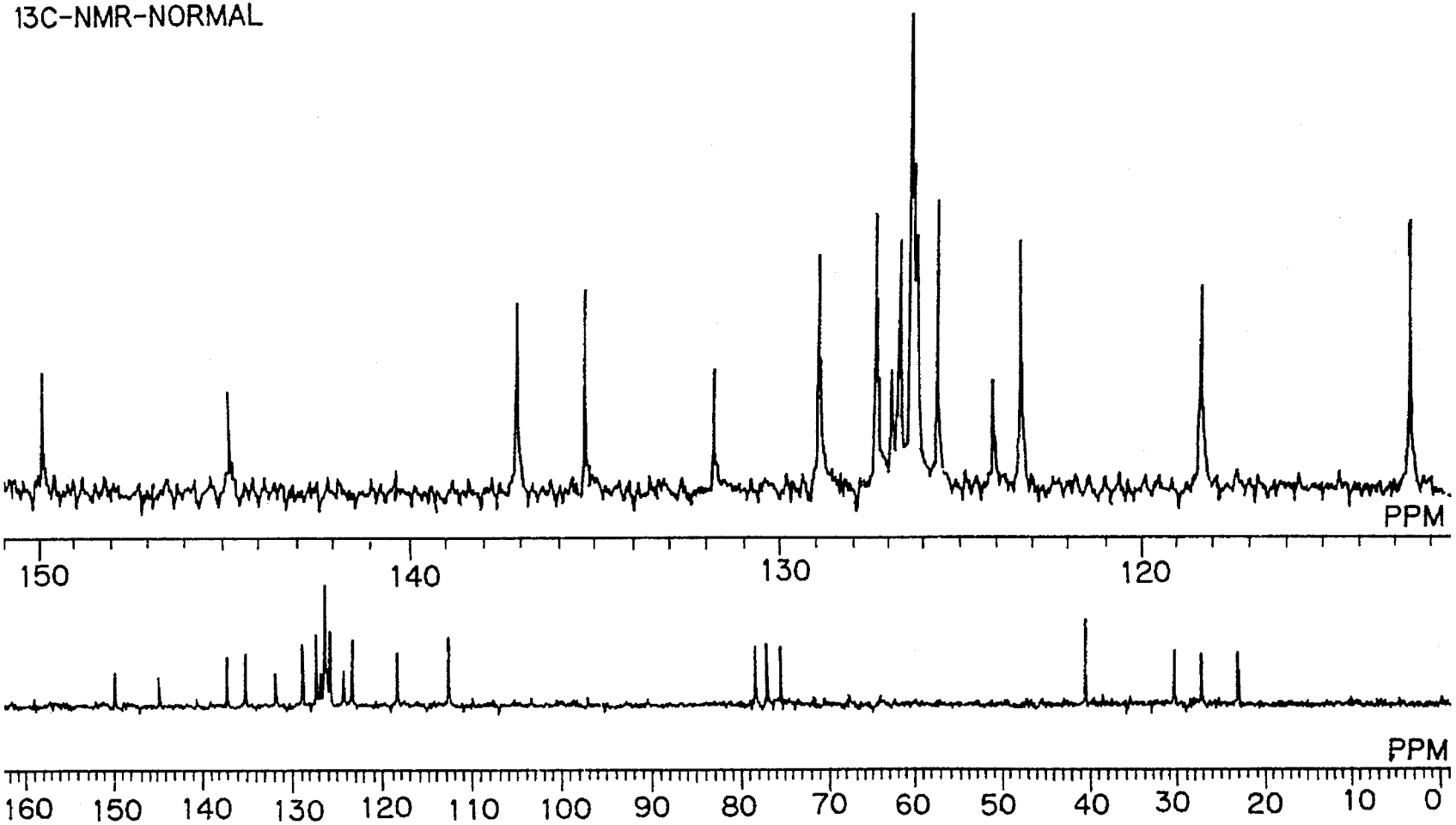
FIG. 17 is a usual $^{13}$C-NMR spectrum of Exemplary Compound No. 261 of the present invention.
Figure 18:
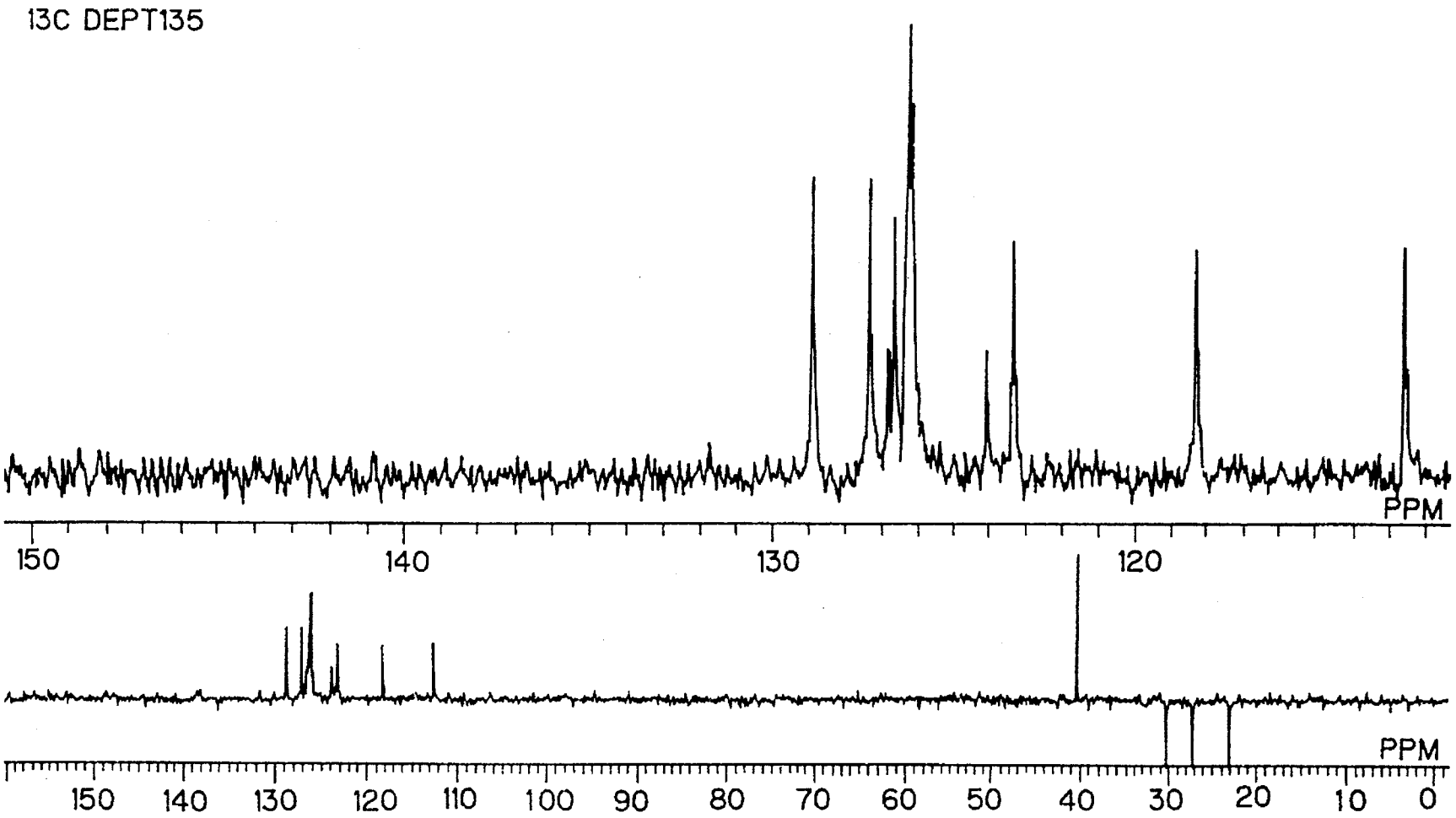
FIG. 18 is a $^{13}$C-NMR spectrum by DEPT-135 of Exemplary Compound No. 261 of the present invention.

In the two spectra in FIGS. 17 and 18, three peaks of methylene groups were observed at 23.00, 27.21 and 30.28 ppm, respectively, and a peak of carbon belonging to an N-methyl group was also observed at 40.48 ppm, by which Exemplary Compound No. 261 was characterized.

A bis-azo pigment represented by the formula

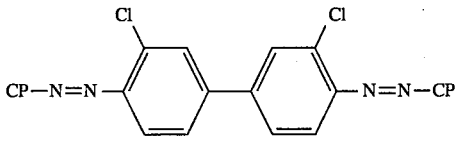

-continued (wherein CP is 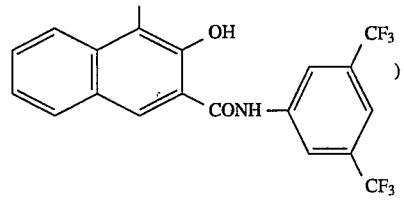

)

was added to a 1% THF solution of a phenoxy resin (trade name PKHH, made by Union Carbide Corp.), the amount of the pigment being equal to that of the resin in terms of weight. The resultant mixture and glass beads having a diameter of 1.5 mm were then dispersed in a paint conditioner (made by Red Devil Co., Ltd.) for about 2 hours. Next, the thus obtained dispersion was applied onto an aluminum-deposited polyester film (thickness =80 μm) as a support by a doctor blade method, followed by drying to form a pigment layer (a carrier generation layer). The dried film had a thickness of 0.2 μm.

Afterward, 1 g of each of Exemplary Compound Nos. 226, 234, 261, 280 and 297 of the present invention and 1.2 g of a polyarylate resin (trade name U-100, made by Unitika Ltd.) were dissolved in methylene chloride to form a 15% solution, and this solution was then applied onto the already formed pigment layer (the carrier generation layer) by a squeegeeing doctor to form a resin-enamine derivative solid solution phase (a carrier transport layer) having a dried film thickness of 25 μm.

For the thus laminated electrophotographic photoreceptor, electrophotographic properties were evaluated by means of an electrostatic recording paper test device (trade name SP-428, made by Kawaguchi Denki Co., Ltd.). Under measurement conditions of an applied voltage of −6 kV and a static of No. 3, an exposure $E_{100}$ (lux-second) required to attenuate from −700 V to −100 V by irradiation with white light (irradiated light=5 lux) and an initial voltage $v_0$ (−voltage) were measured, and the measured values are shown in Table 31.

Furthermore, after an operation of electrification and non-electrification (non-electrification light: irradiation with the white light at 40 lux for 1 second) was repeated 10,000 times by the use of the same device, the initial voltage $V_0$ (−voltage) and the $E_{100}$ (lux.second) were measured to inspect changes of the $V_0$ and the $E_{100}$.

TABLE 31

| Electrophotographic Photoreceptor | Examplary Compound No. | Repeating Properties 1st Time $V_0$ (V) | 1st Time $E_{100}$ (lux · sec) | 10000th Time $V_0$ (V) | 10000th Time $E_{100}$ (lux · sec) |
|---|---|---|---|---|---|
| Example 33 | No. 226 | 830 | 1.6 | 825 | 1.7 |
| Example 34 | No. 234 | 805 | 1.9 | 800 | 2.1 |
| Example 35 | No. 261 | 835 | 2.1 | 820 | 2.2 |
| Example 36 | No. 280 | 860 | 1.8 | 845 | 1.9 |
| Example 37 | No. 297 | 840 | 2.4 | 830 | 2.6 |

It is apparent from Table 31 that the photoreceptors using the enamine derivatives of the present invention are particularly excellent in sensitivity and repeating properties.

EXAMPLE 38

0.4 g of X type metal-free phthalocyanine (trade name Firstgen Blue 8120, made by Dainippon Ink & Chemicals, Inc.) was added to 30 ml of an ethyl acetate solution in which 0.3 g of a vinyl chloride-vinyl acetate copolymer resin (trade name Eslex M, made by Sekisui Chemical Co., Ltd.) was dissolved, and the mixture was then dispersed in a paint conditioner for about 20 minutes. Next, the thus obtained dispersion was applied onto an aluminum-deposited polyester film by a doctor blade method to form a carrier generation layer so that the thickness of the dried layer might be 0.4 μm.

A polyarylate layer containing 50% by weight of the enamine derivative Exemplary Compound No. 258 was laminated on this carrier generation layer to form a photoreceptor having a double-layered structure.

For the photoreceptor, an energy ($E_{50}$) required to reduce its potential by half and an initial potential ($-V_0$) were measured by the use of a spectrum at 780 nm. As a result, the $V_0$ was 870 V and the $E_{50}$ was 2.0 erg/cm$^2$, and it was apparent that the photoreceptor had a very high sensitivity and high charging properties.

Furthermore, a laser printer (WD-580P) made by Sharp Corporation was remodeled, and the above-mentioned photoreceptor was attached to a drum portion of the printer. Afterward, non-copy aging was continuously carried out 10,000 times to inspect the deterioration of the initial potential and the sensitivity. As a result, the $V_0$ was 865 V and the $E_{50}$ was 2.0 erg/cm$^2$, and they scarcely lowered, as compared with those of the first test.

EXAMPLES 39 to 42

In methylene chloride were dissolved 1 g of each of Exemplary Compound Nos. 225, 260, 262 and 294, 1.1 g of a polyarylate resin represented by the following formula, 0.15 g of N,N-3,5-xylyl-3,4-xylyl-3,4,9,10-perylenetetracarboxylimide and 0.05 g of an ultraviolet light absorber (the imide compound was partially in a dispersion state), and the resultant solution was then applied, by an applicator, onto a support obtained by subjecting the surface of an aluminum substrate to an Alumite treatment (an Alumite layer=7 μm) to obtain a single-layered photoreceptor having a dried film thickness of 20 μm:

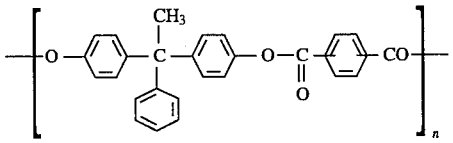

For the thus obtained photoreceptor, electrophotographic properties were measured by an electrostatic recording paper test device under measurement conditions of an applied voltage of +5.5 kV and a static of No. 3. An exposure $E_{100}$ (lux.second) required to attenuate from +700 V to +100 V by irradiation with white light was measured, and the measured values are shown in Table 32. Moreover, a non-copy aging test was carried out 10,000 times to inspect the deterioration of the sensitivity $E_{100}$, and the results are shown in Table 32.

TABLE 32

| Electrophotographic Photorerecptor | Exemplary Compound | Repeating Properties $E_{100}$ (lux · sec) 1st Time | 10000th Time |
|---|---|---|---|
| Example 39 | No. 225 | 2.1 | 2.2 |
| Example 40 | No. 260 | 1.8 | 2.0 |
| Example 41 | No. 262 | 1.9 | 2.1 |
| Example 42 | No. 294 | 2.2 | 2.3 |

It is apparent that the photoreceptors using the enamine derivatives of the present invention are also excellent in sensitivity and repeating properties even in the case of the positive charging.

EXAMPLES 43 to 47

By the use of Exemplary Compound Nos, 226, 234, 261, 280 and 297, laminated electrophotographic photoreceptors were prepared under the same conditions as in Examples 33 to 37, and electrophotographic properties were then evaluated under circumstances of a temperature of 35° C. and a humidity of 85% by means of an electrostatic recording paper test device (trade name SP-428, made by Kawaguchi Denki Co., Ltd.).

Under measurement conditions of an applied voltage of −6 kV and a static of No. 3, an initial voltage $V_0$ (−voltage) was measured, and the measured values are shown in Table 33. Furthermore, after an operation of electrification and non-electrification (non-electrification light: irradiation with the white light at 40 lux for 1 second) was repeated 10,000 times by the use of the same device, the initial voltage $V_0$ (−voltage) was measured to inspect a change of the $V_0$. The results are shown in Table 33.

TABLE 33

| Electrophotographic Photorerecptor | Exemplary Compound | Repeating Properties 1st Time $V_0$ (V) | 10000th Time $V_0$ (V) |
|---|---|---|---|
| Example 43 | No. 226 | 850 | 840 |
| Example 44 | No. 234 | 820 | 810 |
| Example 45 | No. 261 | 855 | 830 |
| Example 46 | No. 280 | 870 | 850 |
| Example 47 | No. 297 | 860 | 845 |

It is apparent from Table 33 that the enamine derivatives of the present invention are also excellent in stability to temperature and humidity.

What is claimed is:

1. An electrophotographic photoreceptor comprising:

a conductive support; and a photosensitive layer formed on the conductive support, the photosensitive layer containing an enamine derivative as a carrier transport material represented by the formula (I)

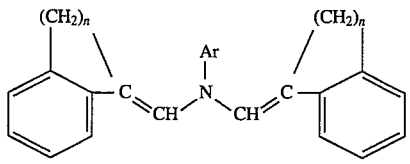

(I)

wherein Ar is an aryl group or substituted aryl group selected from the group consisting of phenyl, tolyl, methoxyphenyl, ethoxyphenyl, isopropylphenyl, fluorophenyl, trifluoromethylphenyl, dimethylaminophenyl, naphthyl, methylnaphthyl, biphenyl, methylbiphenyl, methoxybiphenyl, anthryl, tetralinyl and indanyl group; a heterocyclic group or substituted heterocyclic group selected from the group consisting of pyridyl, pyrimidyl, benzothiofuranyl, fluoroenonyl, acridinyl, 2,1,3-benzothiadiazolyl, 2-benzothiadiazolyl, 6-methoxy-2-benzothiadiazolyl, 2-benzoxazplyl, 2-methyl-5-benzoxazolyl, 4-phenyl-2-thiazolyl, 5-ethyl-2-1,3,4-thiadiazolyl and 5methyl-3-isoxazolyl; an aralkyl group or substituted aralkyl group selected from the group consisting of benzyl, methoxybenzyl and methylbenzyl; or a heterocyclic substituted alkyl group; and n is 2, 3 or 4.

2. The electrophotographic photoreceptor according to claim 1 wherein n is 3.

3. The electrophotographic photoreceptor according to claim 1, wherein said photosensitive layer contains the enamine derivative of the formula (I) as a carrier transport material, and a carrier generation material.

4. The electrophotographic photoreceptor according to claim 1, wherein said photosensitive layer comprises a carrier generation layer containing a carrier generation material and a carrier transport layer containing the enamine derivative of the formula (I) as a carrier transport material.

5. The electrophotographic photoreceptor according to claim 1, wherein a surface protective layer is further formed on said photosensitive layer.

6. The electrophotographic photoreceptor according to claim 1, wherein an intermediate layer comprising a material is selected from the group consisting of casein, polyvinyl, butyral, polyvinyl alcohol, nitrocellulose, ethylene-acrylic add copolymer polyamide, copolymer, nylon, alkoxymethylated nylon, polyurethane, gelatin and aluminum oxide.

* * * * *